US005437444A

United States Patent [19]

Kawakami et al.

[11] Patent Number: 5,437,444

[45] Date of Patent: Aug. 1, 1995

[54] SHEET SUPPLYING APPARATUS

[75] Inventors: Hideaki Kawakami, Yokohama; Takehiko Kiyohara, Zama; Tetsuo Suzuki, Yokohama; Junichi Asano, Kawasaki; Soichi Hiramatsu, Yokohama; Masahiro Taniguro, Yokohama; Hiroyuki Saito, Yokohama; Haruyuki Yanagi, Yokohama; Takashi Nojima, Tokyo; Satoshi Saikawa, Inagi; Hiroyuki Kinoshita, Kawasaki, all of Japan

[73] Assignee: Canon Kabushiki Kaisha, Tokyo, Japan

[21] Appl. No.: 28,818

[22] Filed: Mar. 10, 1993

[30] Foreign Application Priority Data

Mar. 12, 1992 [JP] Japan ..... 4-087595
Jul. 31, 1992 [JP] Japan ..... 4-225143

[51] Int. Cl.[6] ..... B65H 3/30

[52] U.S. Cl. ..... 271/22; 271/121; 271/127; 271/170; 271/171

[58] Field of Search ..... 271/21, 22, 126, 127, 271/121, 170, 171

[56] References Cited

U.S. PATENT DOCUMENTS 4,363,477 12/1982 Miyashita ..... 271/170 X
4,595,191 6/1986 Uchiyama ..... 271/170
5,114,133 5/1992 Osada ..... 271/22

FOREIGN PATENT DOCUMENTS 276737 11/1990 Japan .

*Primary Examiner*—David H. Bollinger
*Assistant Examiner*—Carol L. Druzbick
*Attorney, Agent, or Firm*—Fitzpatrick, Cella, Harper & Scinto

[57] ABSTRACT

The present invention provides a sheet supplying apparatus having an extendible sheet support for supporting sheets, a sheet supply for feeding out the sheets supported by the sheet support, a shiftable separating claw capable of separating the sheets fed by the sheet supply, one by one, by engaging from corners of the sheets supported by the sheet support, a regulator for shifting the separating claw toward the sheet support in response to insert and retracting movements of the sheet support and a second separator for separating the sheets rested on an upper surface of the separating claw shifted toward the sheet support by the regulator, one by one, when the sheets are fed out by the sheet supply.

21 Claims, 20 Drawing Sheets

SHEET SUPPLYING APPARATUS

BACKGROUND OF THE INVENTION

1. Field of the Invention

The present invention relates to a sheet supplying apparatus having a separating pawl or claw, and more particularly, it relates to a sheet supplying apparatus having a separating claw wherein the separating claw separation and the ramp separation can be switched.

2. Related Background Art

In the past, there have been proposed sheet supplying apparatuses wherein sheets are separated one by one, from a sheet stack, by both the normal sheet separating claw separation, and the ramp separation in which the sheets are separated by an inclined portion or ramp portion for guiding the sheet. In the conventional apparatuses, the claw separation was switched to the ramp separation by greatly retarding the separating claw upwardly and the claw separation was not switched to the ramp separation by keeping the claw at an initial position.

However, with the arrangement as in the above conventional case, since the separating claw had to be retarded greatly, the whole apparatus was large. Further, since an operator had to perform the switching operation directly, the switching operation was troublesome and it was feared that the operator could forget to perform the switching operation.

SUMMARY OF THE INVENTION

The present invention aims to eliminate the above conventional drawbacks, and an object of the present invention is to provide a sheet supplying apparatus having a separation claw, which is small-sized and eliminates the erroneous operation for switching the separation claw.

The sheet supplying apparatus according to the present invention comprises sheet supporting means for supporting sheets, sheet supply means for feeding out the sheets supported by the sheet supporting means at a sheet supply position, a shiftable separating claw capable of separating the sheets fed by the sheet supply means, one by one, by engaging with front corners of the sheets supported by the sheet supporting means, a hopper plate telescopically supported for inserting and retracting movement with respect to the sheet supplying apparatus and adapted to partially support the sheets supported by the sheet supporting means, regulating means for regulating the separating claw by shifting it toward the sheet supporting means in response to the inserting and retracting movement of the hopper plate, and second separation means for separating the sheets one by one when the sheets are rested on an upper surface of the separating claw shifted toward the sheet supporting means by the regulating means and the sheets are fed out by the sheet supplying means.

With this arrangement, the separating claw can be switched by the regulating means between a separation permitting position and a separation inhibiting position. For example, when soft sheets having a large size are supplied, by retracting the hopper plate acting as an auxiliary tray, the separating claw is brought to the separation permitting position, and, when the hard sheets having a small size such as post cards, are supplied, by inserting the hopper plate, the separating claw is retarded toward the sheet supporting means. That is, when soft sheets having a large size are set on the sheet supporting means, since an operator is aware of the necessity of hopper plate as the auxiliary tray for supporting the trailing ends of the sheets, as the operator retracts the hopper plate, a separating claw separation mode is automatically obtained. On other hand, when the hard sheets are to be supplied, since the operator is aware of the unnecessity of the hopper plate as the auxiliary tray, the operator can insert the hopper plate, thereby automatically obtaining a separation mode not using the separation claw.

In this way, it is possible to perform the switching of the separating claw without an erroneous operation and to make the apparatus small-sized.

DETAILED DESCRIPTION OF THE PREFERRED EMBODIMENTS

The present invention will now be explained in connection with embodiments thereof with reference to the accompanying drawings.

First of all, a first embodiment of the present invention will be described.

Figure 1:
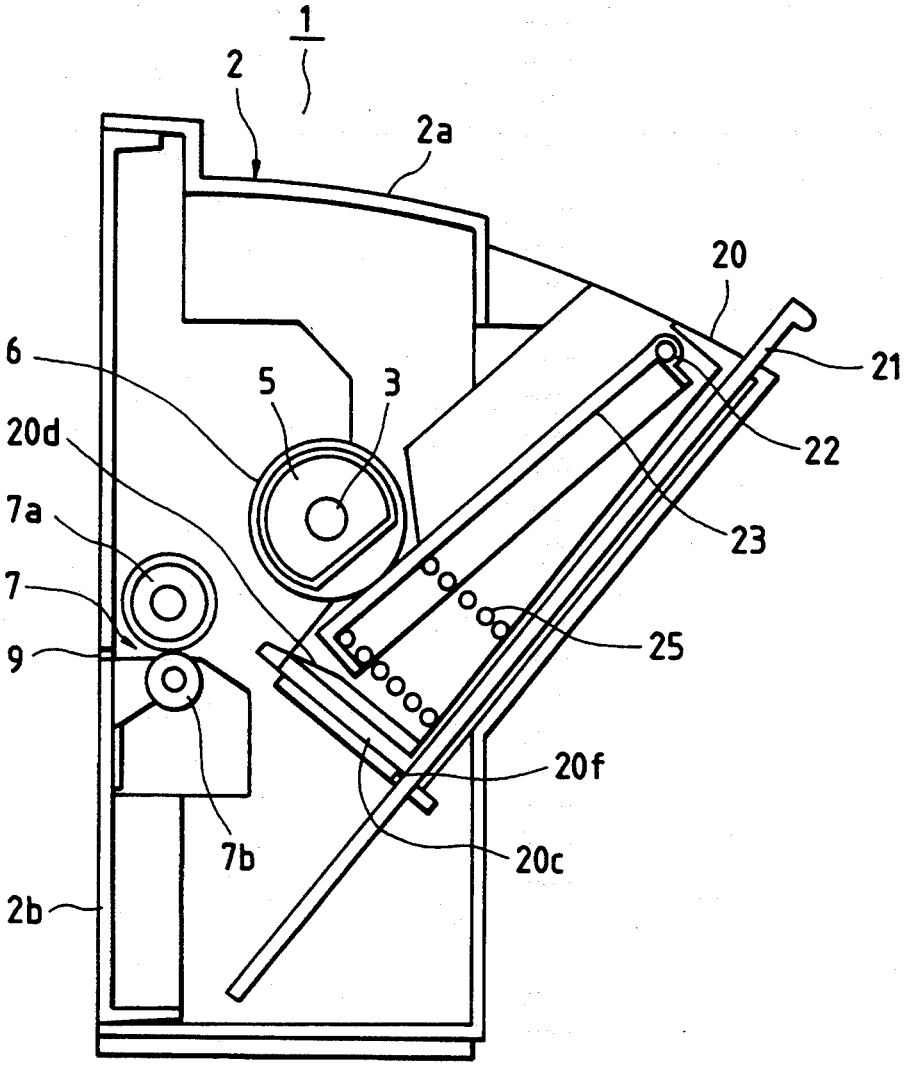
FIG. 1 is an elevational sectional view of a sheet supplying apparatus according to a preferred embodiment of the present invention.
Figure 6:
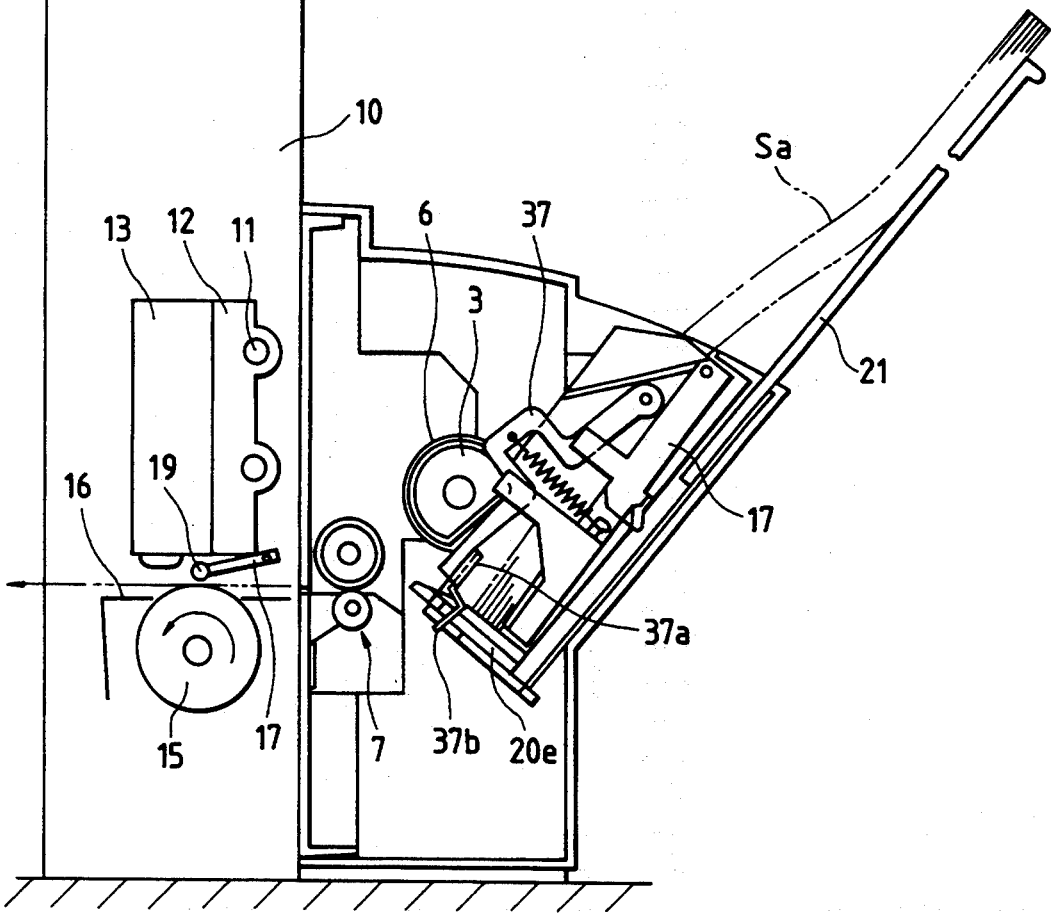
FIG. 6 is an elevational sectional view of the sheet supplying apparatus of FIG. 1 connected to a recording system.
Figure 10:
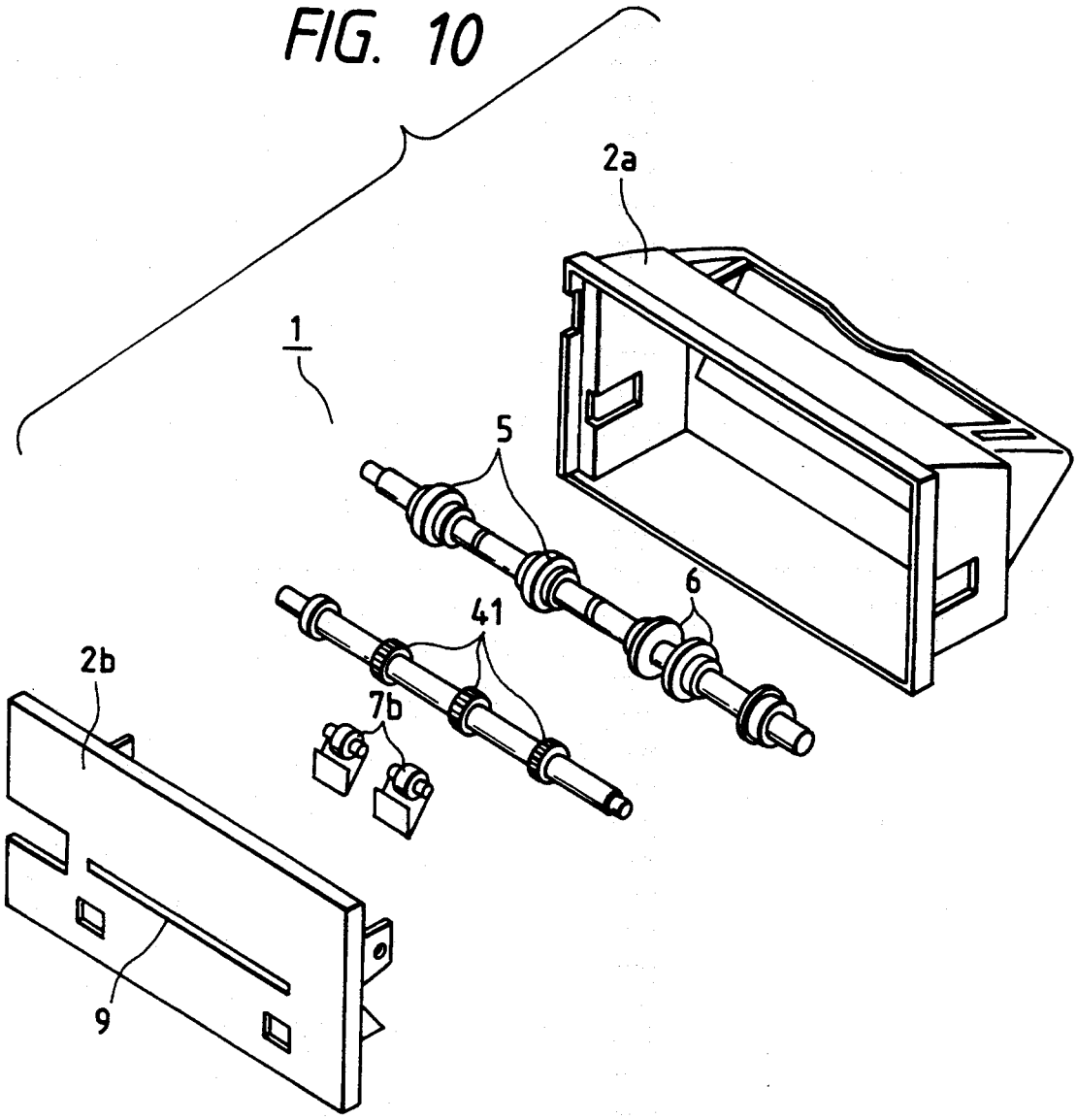
FIG. 10 is an exploded perspective view of a frame and rollers of the sheet supplying apparatus of FIG. 1.

In FIGS. 1 and 10, a body 2, of a sheet supplying apparatus 1 having a separating pawl or claw, comprises a body cover 2*a*, and a front side plate 2*b* secured to a downstream end of the cover. Semi-circular sheet supply rollers 5 for supplying a sheet, rollers 6 rotatably mounted on a shaft 3 on which the sheet supply rollers 5 are secured, and a pair of convey rollers 7 comprising a pinch roller 7*b* and a driven roller 7*a* for feeding the sheet toward a downstream direction, are incorporated within the body 2. As shown in FIG. 6, the sheet supplying apparatus 1 is mounted at an upstream side of a printer 10.

The printer 10 comprises a feed roller 15 for feeding the sheet supplied from the sheet supplying apparatus 1, a platen 16 for guiding the sheet, a hold-down roller 19 mounted on a free end of a support lever 17 and adapted to urge the sheet against the feed roller 15, a carriage 12 guided by a plurality of guide shafts 11 and movable in a direction transverse to the sheet, and a recording head 13, mounted on the carriage 12, and adapted to record an image on the sheet in correspondence to image information. The recording head 13 is of ink jet type wherein ink is discharged from discharge opening of the head by the growth and contraction of bubbles caused by heating the ink more than the film boiling temperature by means of electrothermal converters, thereby forming the image on the sheet.

In FIG. 1, a hopper 20 is secured to the body cover 2*a* and has opposite side walls 20*a* and 20*b*. Ribs 20*d* each having an inclined or ramp portion at its upper surface are formed on an inner surface of a front side wall 20*c*, which ramp portions of the ribs serve to effect the sheet separation action, i.e., to act on leading ends of the sheets to separate the sheets. A hopper plate 21 is telescopically supported within the hopper 20 of the body 2. A pressure plate 23 is pivotally mounted around a support shaft 22 so that the pressure plate 23 is biased upwardly by a compression spring 25 to be urged against the rollers 6 which define an upper limit position of the pressure plate.

Figure 2:
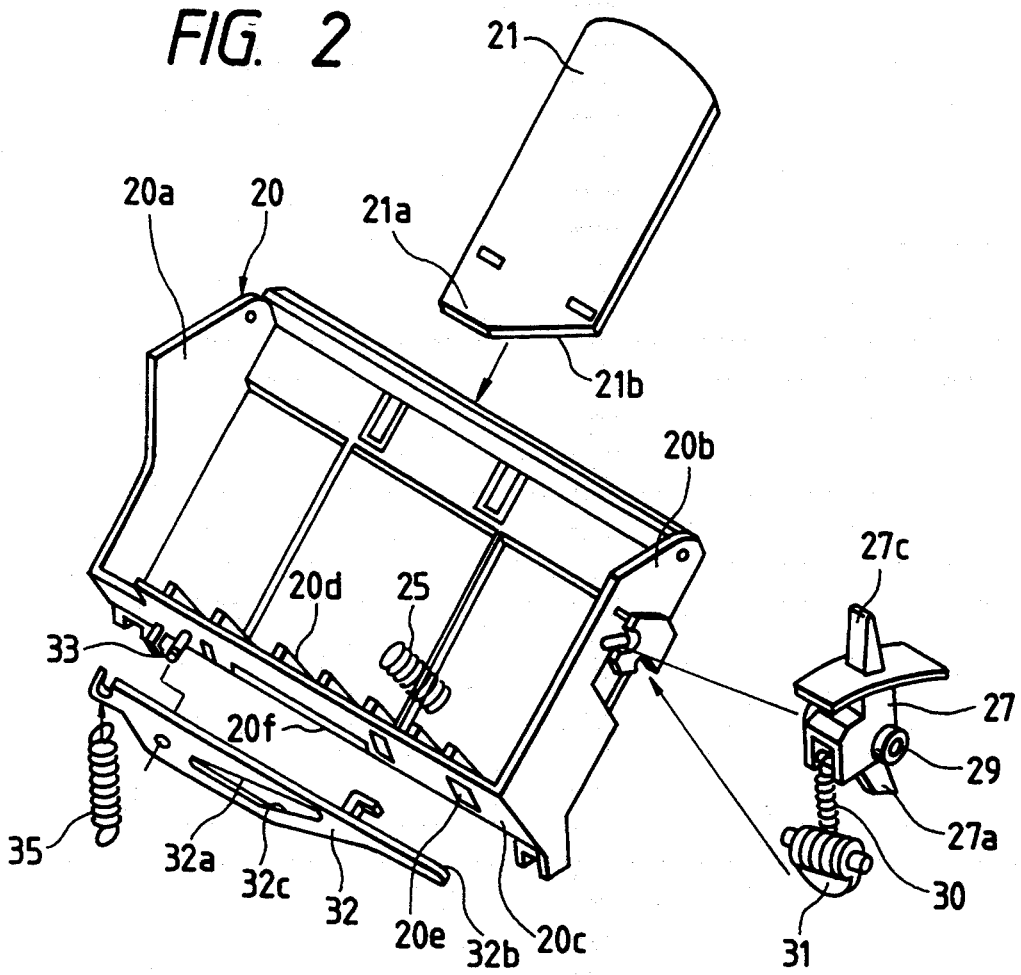
FIG. 2 is an exploded perspective view of a hopper portion of FIG. 1.

In FIG. 2, a switching lever (switching means) 27, for shifting the pressure plate 23 in an up-and-down direction, is provided at a side of the side wall 20*b* and is rotatably mounted on the side wall 20*b* via a support pin 29. A toggle spring 30 has one end engaged by the switching lever 17 and the other end locked by a locking member 31 secured to the side wall 20*b*. By a toggle action of the toggle spring 30, the switching lever 27 is held for movement between a first position A and a second position B shown in FIG. 4. At a downstream side of the hopper 20 there is arranged a regulating lever (regulating means) 32 which is rotatably mounted on the front side wall 20*c* via a support pin 33 and is biased in an anti-clockwise direction (looked at from left in FIG. 2) by a tension spring 35.

The hopper plate 21 is provided with a introduction portion 21*a* having an inclined portion 21*b*. The regulating lever 32 is provided with an opening 32*a* having a cam portion 32*c*, which opening is opposed to an opening 20*f* formed in the hopper plate 21. By inserting or retracting the hopper plate 21, the inclined portion 21*b* of the hopper plate 21 urges the cam portion 32*c* downwardly or is retarded from the cam portion 32*c*, thereby shifting the regulating lever 32 downwardly or upwardly. Incidentally, the cam portion 32*c* has a horizontal portion, and an inclined portion driven by the inclined portion 21*b* of the hopper plate 21.

Figure 3:
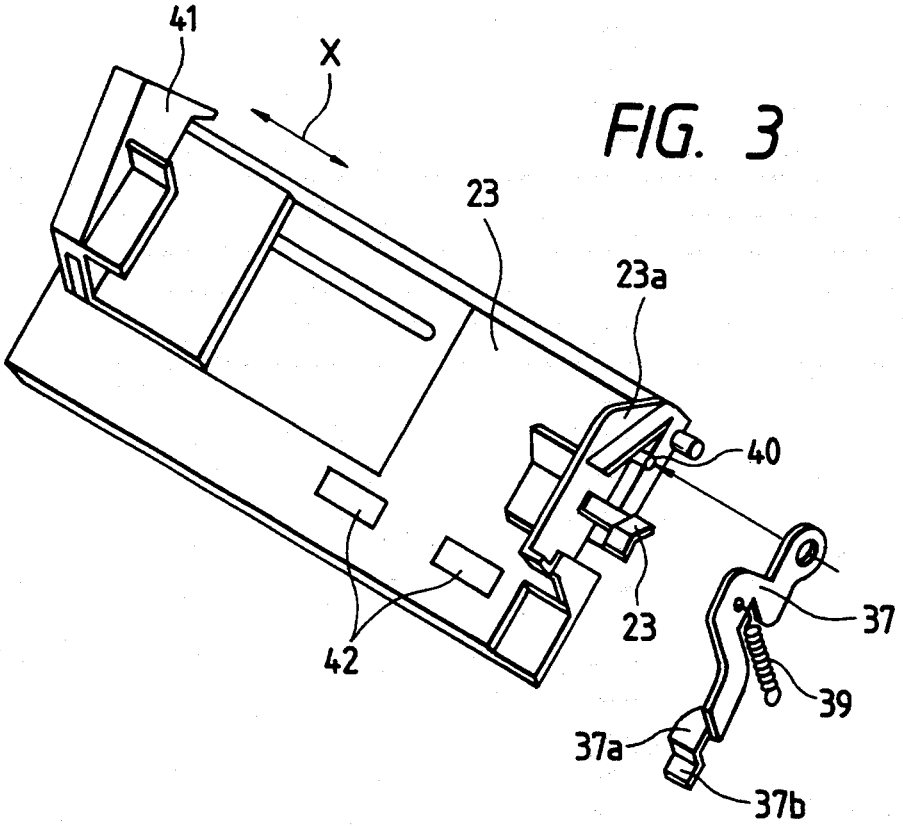
FIG. 3 is a perspective view of a pressure plate portion of FIG. 1.

In FIG. 3, a separating pawl or claw 37 is rotatably mounted on a side wall 23*a* of the pressure plate 23 via a pin 40. The separating claw 37 is biased downwardly, by a spring 39, and is provided at its free end with a pawl portion 37*a* and, an engagement portion 37*b* which extends into a movement path of a free end 32*b* of the regulating lever 32. A biasing force of the engagement portion 37*b* due to the spring 39 is smaller than a biasing force of the free end 32*b* of the regulating lever 32 due to the tension spring 35.

The front side wall 20*c* of the hopper 20 is provided with an opening 20*e* through which the engagement portion 37*b* extends, which opening serves to limit upper movements of the pressure plate 32 and the separating claw 37 (when there are no sheet supply rollers 5). A side plate 41 is shiftable in a direction shown by the arrow X in accordance with the size of the sheet. Separation sheets 42, each comprising a member having high friction of coefficient, are disposed in a confronting relation to the sheet supply rollers 5 and serve to separate the last sheet.

Figure 4:
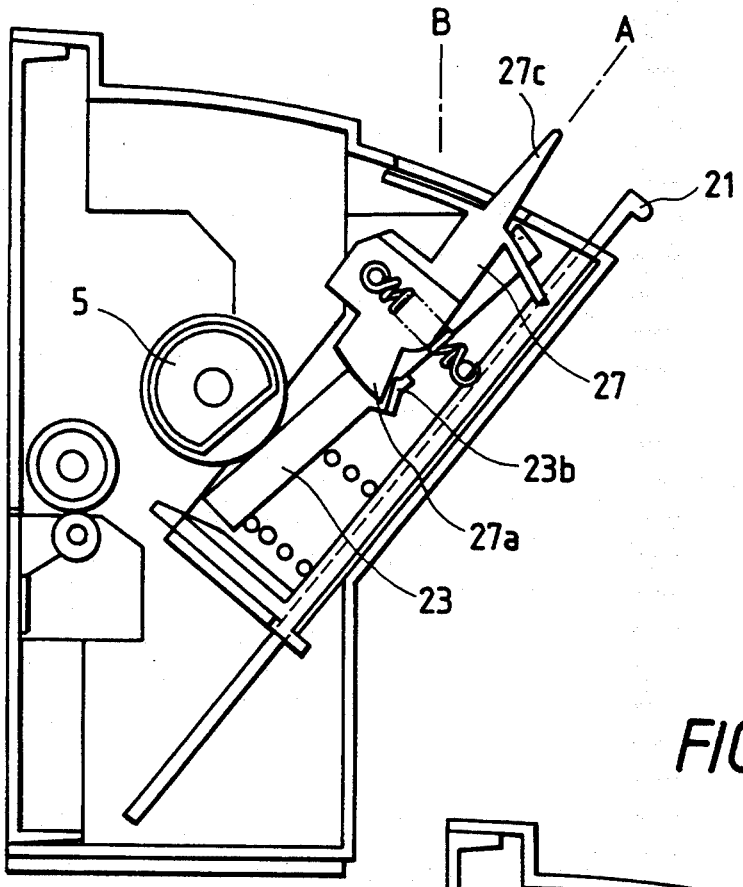
FIG. 4 is an elevational sectional view of the sheet supplying apparatus of FIG. 1, showing a condition that the pressure plate is biased toward sheet supply rollers.
Figure 5:
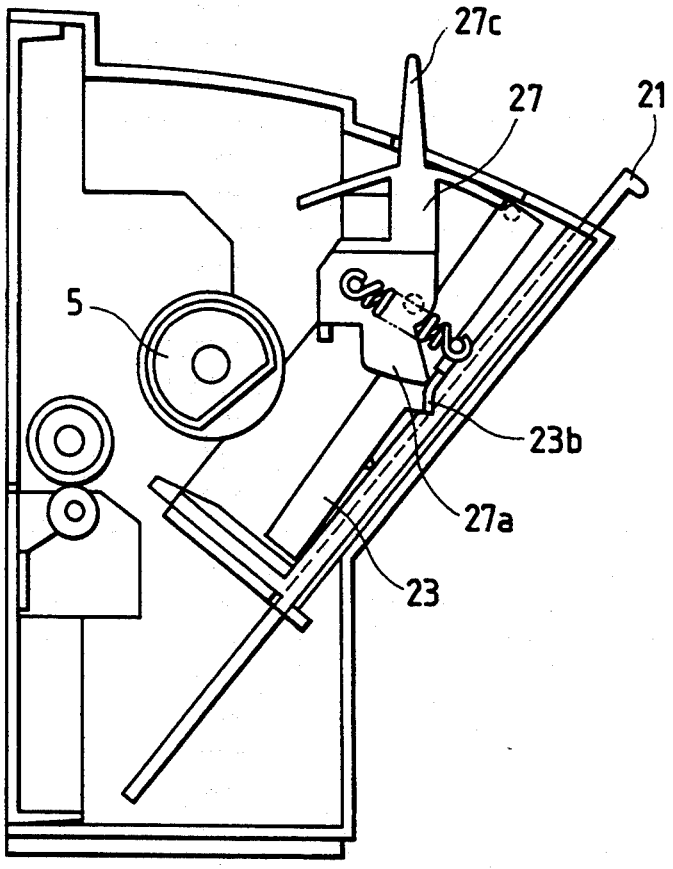
FIG. 5 is an elevational sectional view of the sheet supplying apparatus of FIG. 1, showing a condition that the pressure plate is retarded away from the sheet supply rollers.

When the switching lever 27 is in a position shown in FIG. 4, the pressure plate 23 is in an elevated position. However, when the switching lever 27 is clocked as shown in FIG. 5, a cam portion 27*a* of the switching lever 27 urges an engagement portion 23*b* of the pressure plate 23, thereby pushing the pressure plate downwardly. In this case, since a space is created between the sheet supply rollers 5 and the pressure plate 23, the sheets can be loaded into the space. The switching lever 27 has an operation lever portion 27*c* through which the operator can switch the positions of the pressure plate 23.

Now, the operation of the sheet supplying apparatus 1 will be explained with reference to FIGS. 6 to 9.

Figure 7:
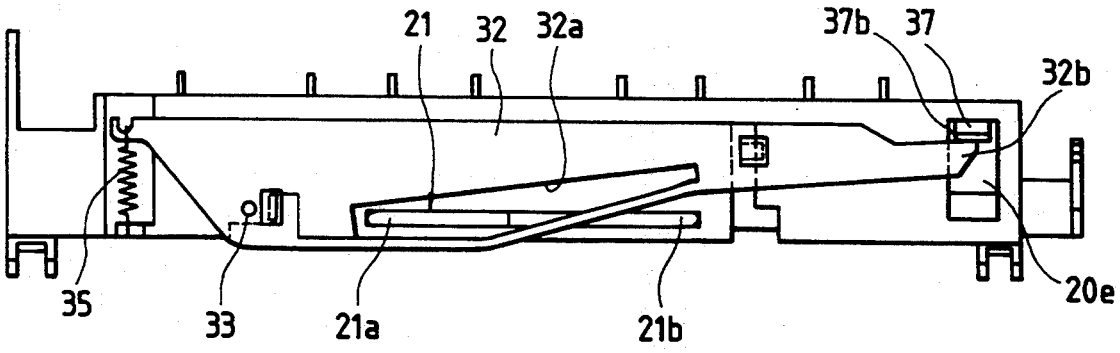
FIG. 7 is a front view of the sheet supplying apparatus in a condition that normal sheets are loaded.
Figure 8:
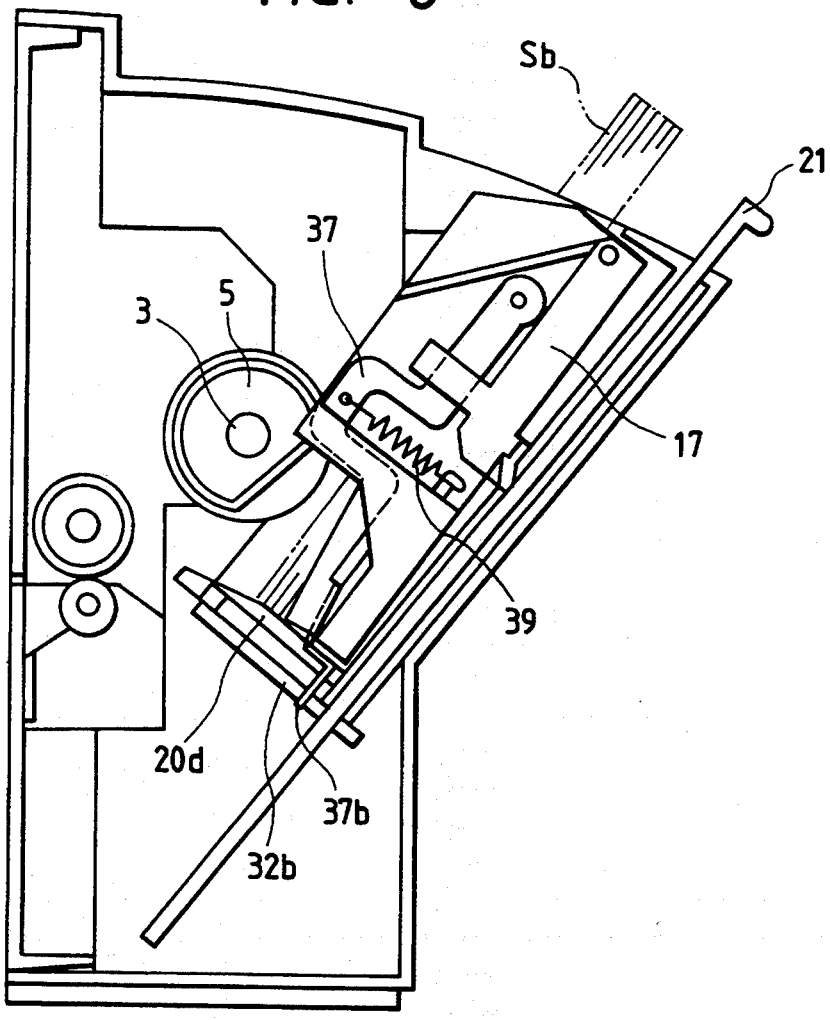
FIG. 8 is an elevational sectional view of the sheet supplying apparatus in a condition that thick sheets are loaded.

In case of normal sheet (long sheet or flexible sheet):

As shown in FIG. 6, the hopper plate 21 is extended by the operator. As a result, as shown in FIG. 7, the free end 32*b* of the regulating lever 32 is shifted to the elevated position. In this condition, even if the operator manipulates the switching lever 27 to lower the pressure plate 23, since the engagement portion 37*b* of the separating claw 37 is held by the free end 32*b* of the regulating lever 32, the separating claw 37 cannot be lowered (because, the biasing force of the spring 39 is weaker than that of the tension spring 35). Accordingly, since the space is created between the pressure plate 23 and the separating claw 37, sheets Sa as normal sheets are inserted into the space. Then, when the pressure plate 23 is lifted by shifting the switching lever 27 reversely, since the leading ends of the sheets Sa are pushed below the separating claw 37, the sheet separation is prepared.

In case of short sheet or hard sheet:

Since sheets Sb such as post cards and the like are short and hard, this case is adopted. Further, regarding long and hard sheets Sb other than the post card, this case is also adopted.

Figure 9:
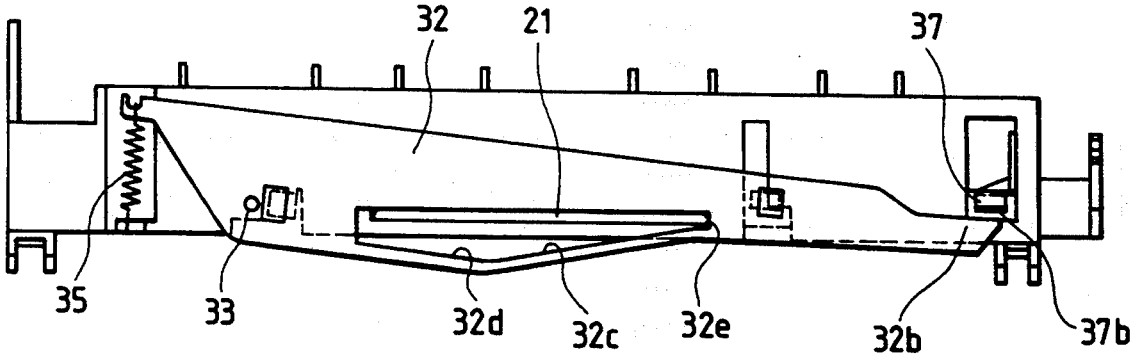
FIG. 9 is a front view of the sheet supplying apparatus of FIG. 8.

When the hopper plate 21 is retracted into the hopper 20 of the body 2 (or is shortened), the introduction portion 21*a* of the hopper plate 21 enters into the cam portion 32*c* of the regulating lever 32, so that the inclined portion 21*b* of the hopper plate 21 urges the cam portion 32*c*, thereby lowering the regulating lever 32. Finally, as shown in FIG. 9, the right end of the hopper plate 21 urges a face 32*e* of the regulating lever 32 to maintain it in the lower position. Consequently, when the pressure plate 23 is lowered by manipulating the switching lever 27, as shown in FIG. 9, the separating claw 37 is also lowered integrally.

Thus, when the sheet Sb are stacked on the lowered pressure plate 23, the sheets Sb are automatically ride on the separating claw 37. At this point, when the pressure plate 23 is lifted by manipulating the switching lever 27, the sheets Sb are urged against the sheet supply rollers 5 and the rollers 6, with the result that the sheets are not subjected to the separation action of the separating claw 37. In this condition, when the sheet supply rollers 5 are rotated, the sheets Sb are ramp-separated one by one by the action of the ramp portion or inclined portions of the ribs 20*d*.

Figure 11:
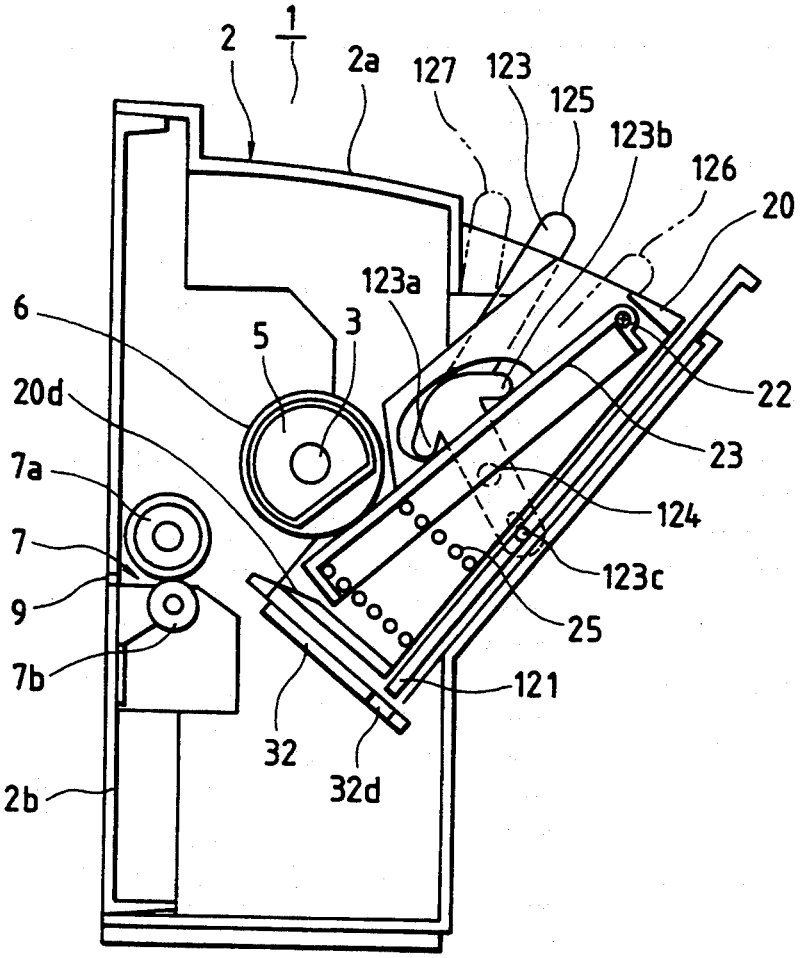
FIG. 11 is an elevational sectional view of a sheet supplying apparatus according to another embodiment of the present invention.
Figure 12:
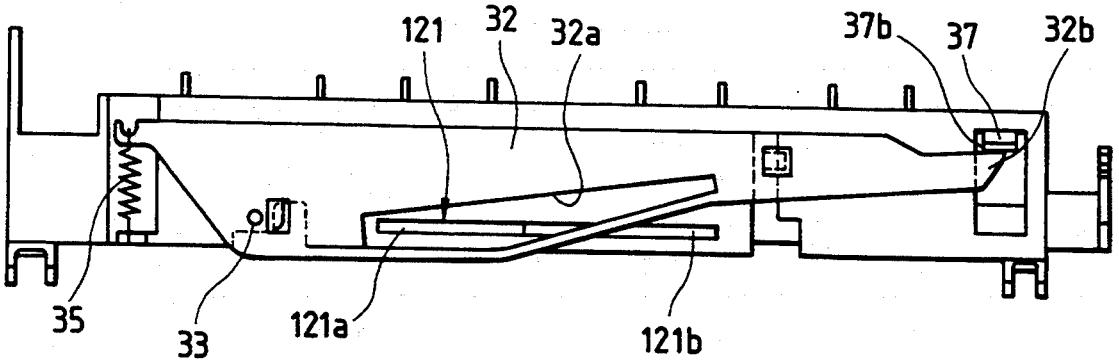
FIG. 12 is a front view of the sheet supplying apparatus of FIG. 11.

Incidentally, the present invention is not limited to the above embodiment, but, for example, in place of the hopper plate, as shown in FIGS. 11 and 12, the upward and downward movement of the regulating means 32 may be limited in response to the operation of a size switching lever 123. The size switching lever controls the regulating means 32 by reciprocally sliding a member 121 such as a telescopic hopper plate. Explaining the operation, when the size switching lever 123 is rotated in a clockwise direction around a shaft 124 to bring a free end of the lever to a position 125, a projection 123*b* formed on the lever 123 lowers the pressure plate 23. Further, since a pin 123*c* formed on the lever 123 at the other end thereof causes the slide member 121 to slide downwardly, the free end of the slide member enters into the opening 32*a* of the regulating means 32, thereby bringing the claw 37 to a condition shown in FIG. 9.

On the other hand, when the lever 123 is rotated in an anti-clockwise direction, a projection 123*b* formed on the lever 123 lowers the pressure plate 23, and the pin 123*c* formed on the lever at the other end thereof slides the slide member 121 upwardly, with the result that, since the regulating means 32 is not controlled by the slide member 121, the regulating means and the separating claw 37 are brought to a condition shown in FIG. 7.

As mentioned above, since the separating claw can be switched between the separation permitting position and the lowered position where the separating claw does not effect the separation action by inserting and retracting the telescopic hopper plate with respect to the body of the apparatus, it is not needed to manually switch the separating claw when the different sheets are used, thereby eliminating the erroneous switching operation for the separating claw and making the apparatus small-sized.

Figure 13A:
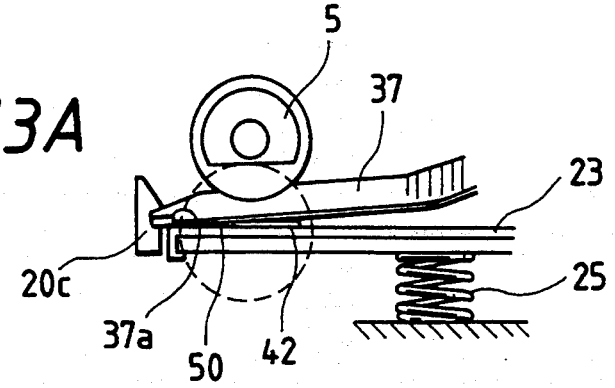
FIG. 13A is a partial sectional view showing a projection arranged at a downstream side of a separation sheet of the sheet supplying apparatus of FIG. 1.
Figure 13B:
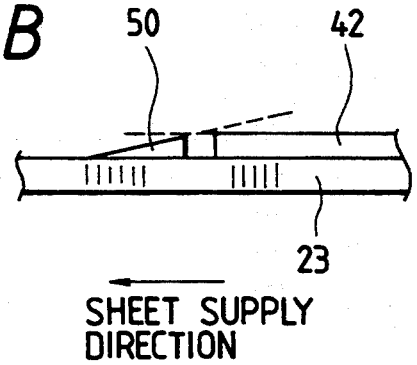
FIG. 13B is an enlarged view of a main portion in FIG. 13A.

In FIGS. 13A and 13B, the separation sheets 42 are formed on the pressure plate 23 in a confronting relation to the sheet supply rollers 5. Since the friction of coefficient between the sheet supply rollers 5 and the separation sheets 42 is greater than that between the sheets, the sheets can be separated one by one by the sheet supply rollers 5. Further, since the friction of coefficient between the sheet and the separation sheet 42 is substantially the same as that between the sheets, the sheets stacked on the pressure plate 23 can be supplied from the first sheet to the last sheet.

Projections 50 each having the same width as that of the separation sheet are formed on the pressure plate 23 at a downstream side of the separation sheets 42 in a sheet feeding direction. These projections 50 serve to prevent a trailing end of the sheet from being caught by the separation sheets 42 when the supplied sheet is fed back half way. The projection and therearound are shown in FIG. 13B in an enlarged scale. Since the height of the projection 50 is lower than that of the separation sheet 42, during the normal sheet supplying operation, the sheet is not caught by the projection 50. Further, since the extension line from an inclined surface of the projection 50 extends over the separation sheet 42, when the sheet is fed back, the trailing end of the sheet is not caught by the separation sheet 42.

Figure 14:
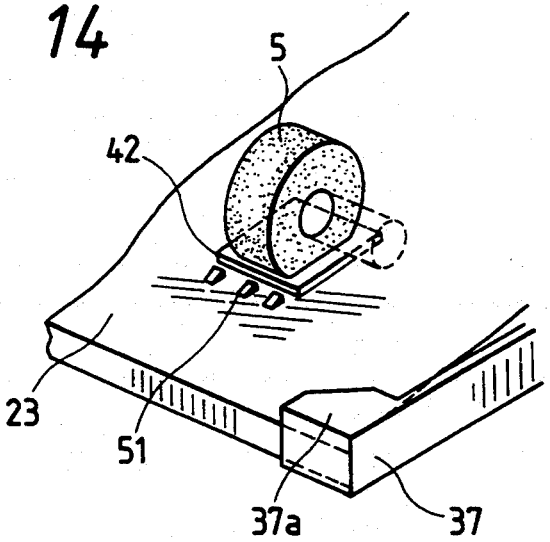
FIG. 14 is a partial perspective view showing ribs arranged at a downstream side of the separation sheet of the sheet supplying apparatus of FIG. 1.

In place of the projections 50, as shown in FIG. 14, ribs 51 may be used. The ribs 51 are formed on the pressure plate 23 at a downstream side of the corresponding separation sheet 42 in the sheet feeding direction. These ribs 51 serve to prevent the trailing end of the sheet from being caught by the separation sheet 42 when the sheet is fed back half way. Incidentally, since the height of each rib 51 is lower than that of the separation sheet, the sheet is not obstructed by the ribs when the sheet is normally fed forwardly.

Figure 15:
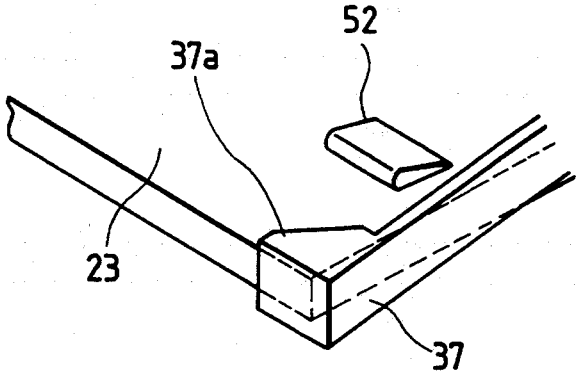
FIG. 15 is a partial perspective view showing a projection arranged at an upstream side of a separation claw of the sheet supplying apparatus of FIG. 1.

When the thick sheets are replenished, it is feared that the leading ends the sheets are caught by the separating claw 37 retarded downwardly. To avoid this, as shown in FIG. 15, a projection 52 is formed on the pressure plate 23 at an upstream side of the pawl portion 37*a* of the separating claw 37. With this projection 52, the sheets can be smoothly stacked on the pressure plate without being caught by the pawl portion 37*a*.

Figure 16:
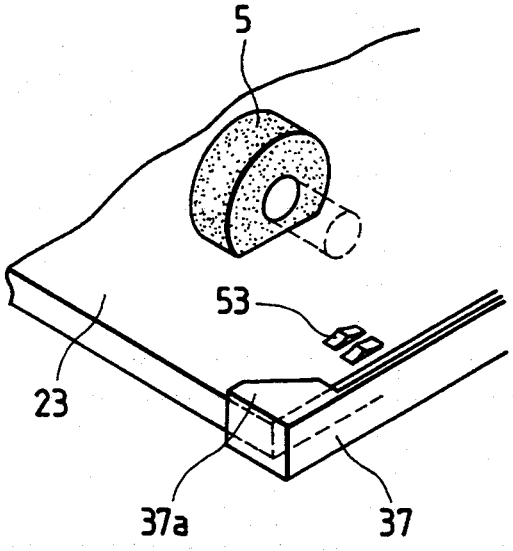
FIG. 16 is a partial perspective view showing ribs arranged at an upstream side of the separation claw of the sheet supplying apparatus of FIG. 1.

Incidentally, in FIG. 15, while the projection 52 had a width greater than that of the pawl portion 37*a* of the separating claw, as shown in FIG. 16, in place of the projection, ribs 53 may be provided.

Next, another embodiment of the present invention will be explained.

Figure 17:
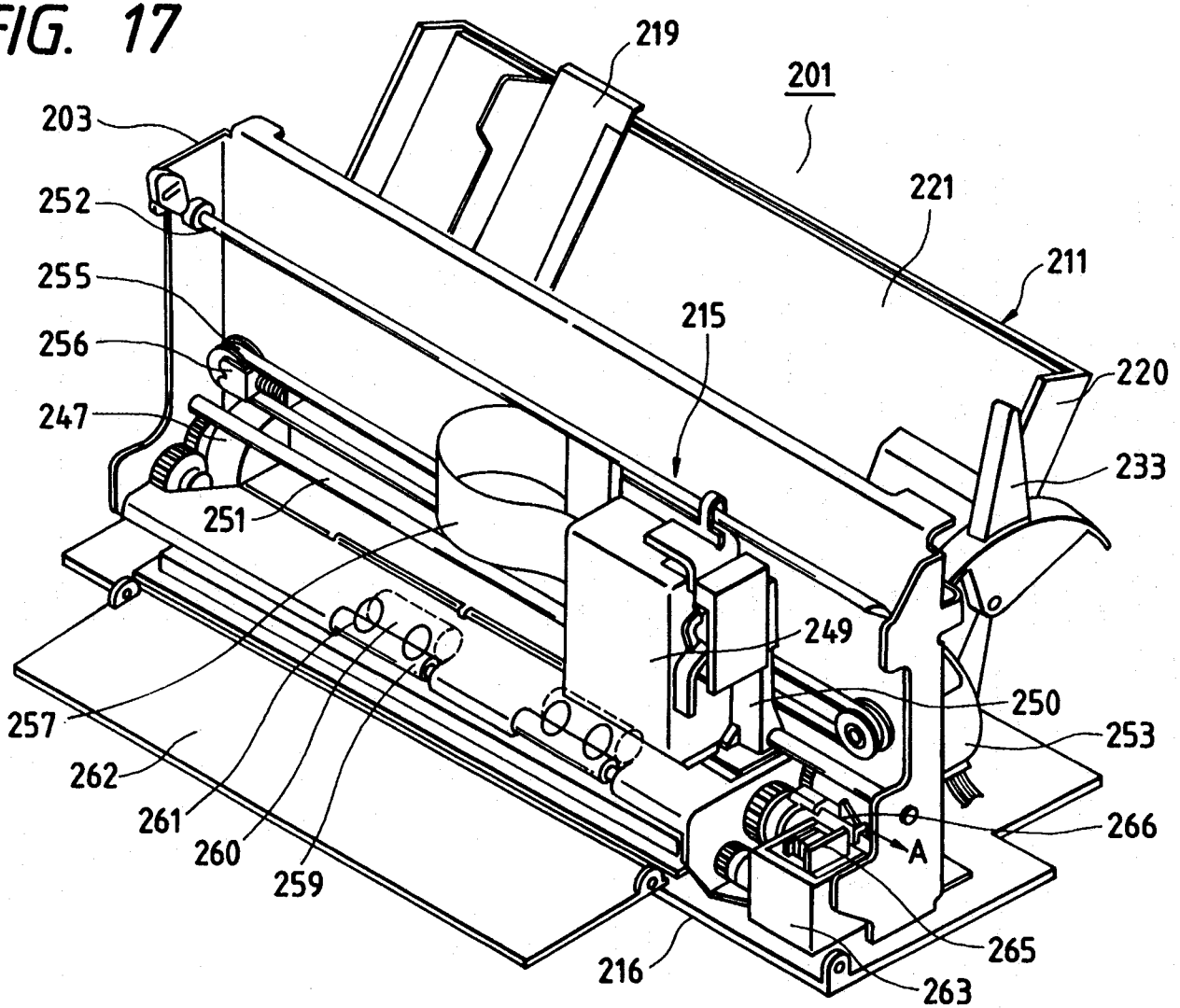
FIG. 17 is a perspective view of a recording system into which the sheet supplying apparatus according to a further embodiment of the present invention is incorporated.
Figure 18:
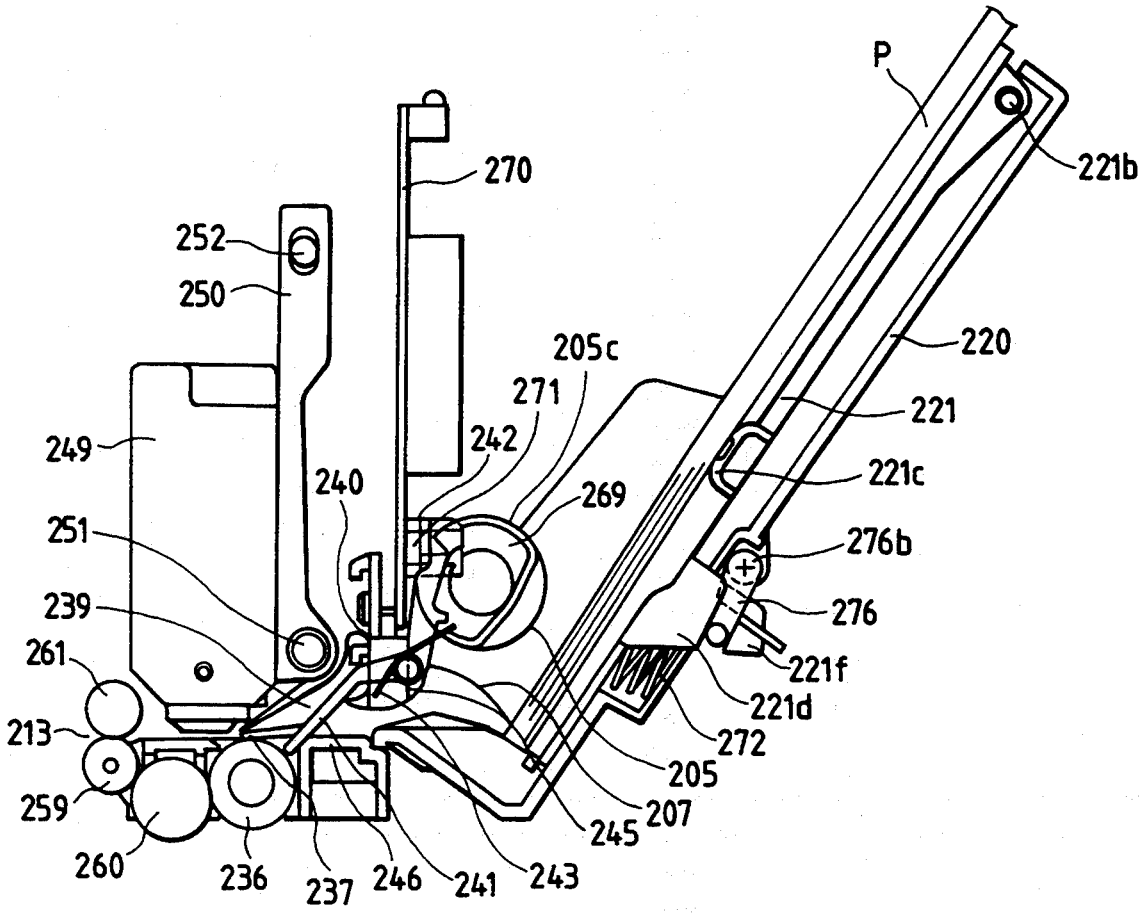
FIG. 18 is a side view of the recording system of FIG. 17.

With reference to FIGS. 17 to 27, a recording system 201 having an automatic sheet supplying ability is constituted by a sheet supply portion 211, a sheet feeding portion 212, a sheet discharge portion 213, a carriage portion 215, and a cleaning portion 216. Now, these portions will be explained in order. Incidentally, FIG. 17 is a perspective view showing the whole construction of the recording system, and FIG. 18 is a side sectional view of the recording system.

Figure 19:
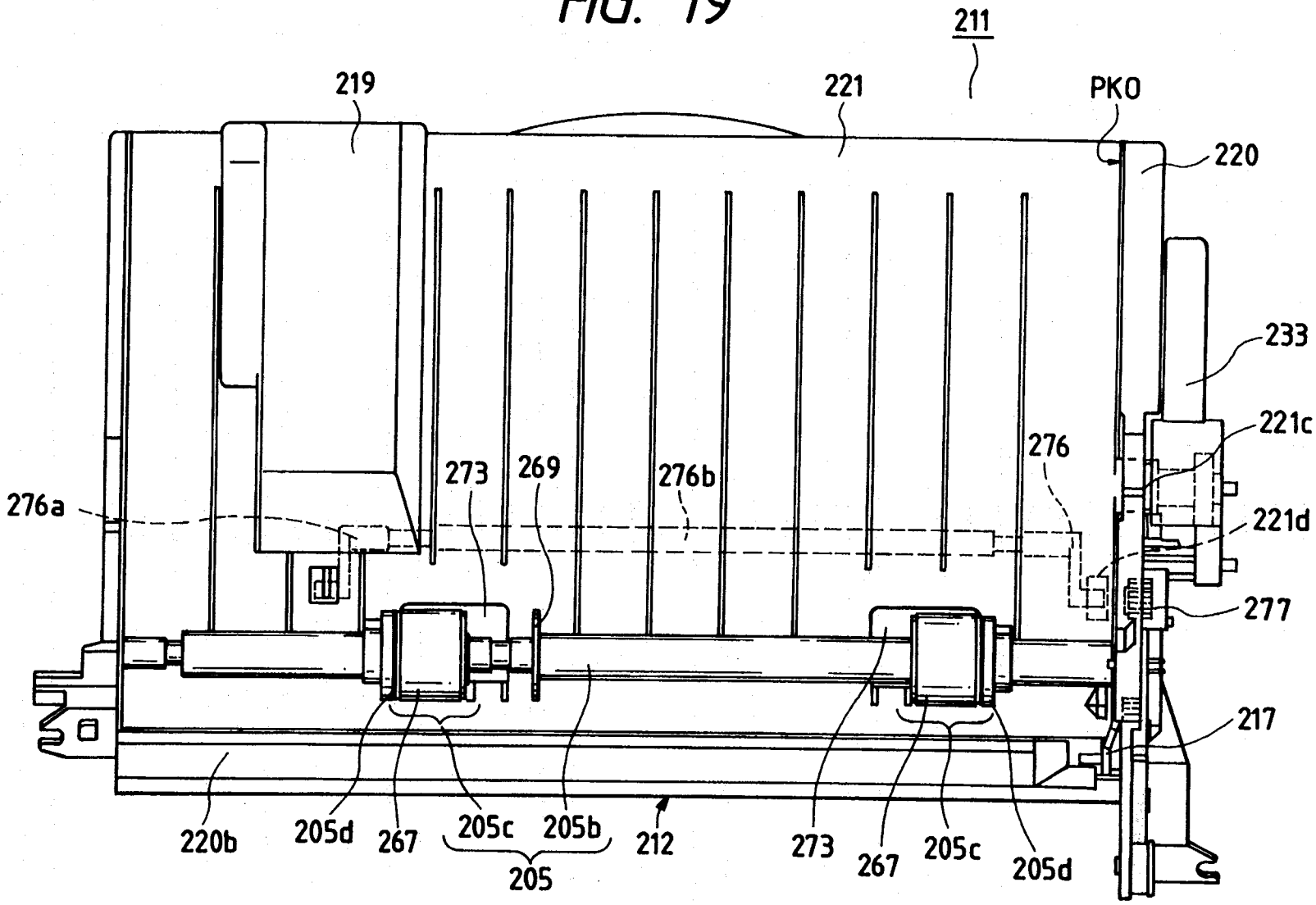
FIG. 19 is a front view of a sheet supply portion of the sheet supplying apparatus according to the further embodiment of the present invention.
Figure 20:
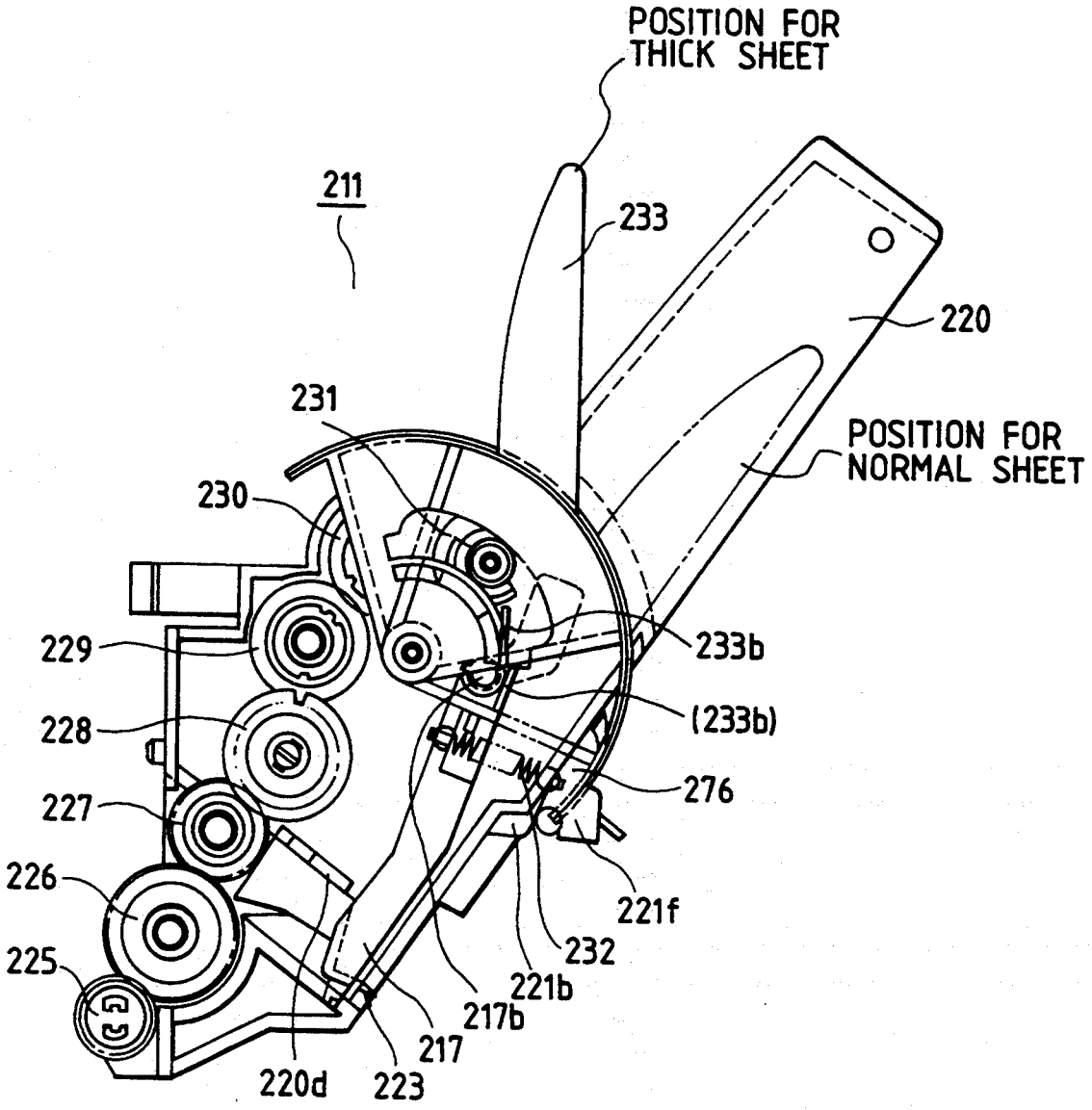
FIGS. 20 to 22 are side views of the sheet supplying apparatus of FIG. 19.
Figure 22:
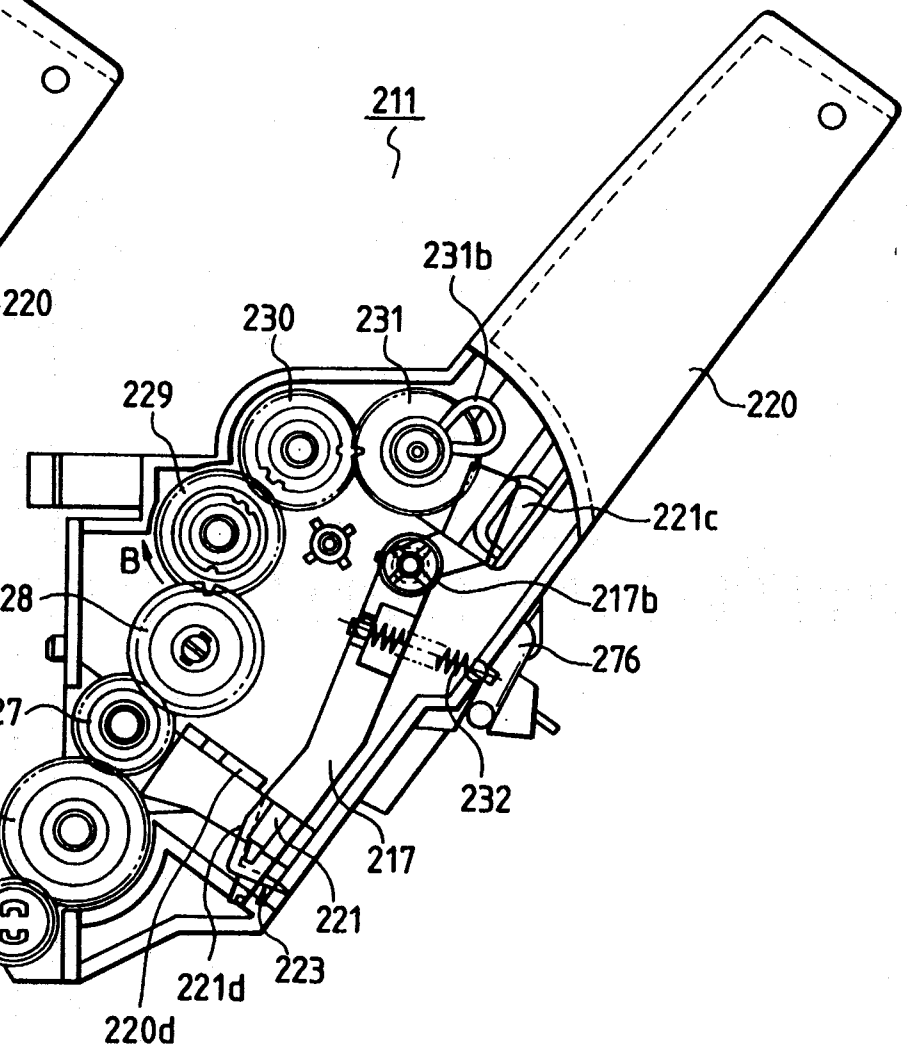
Figure 21:
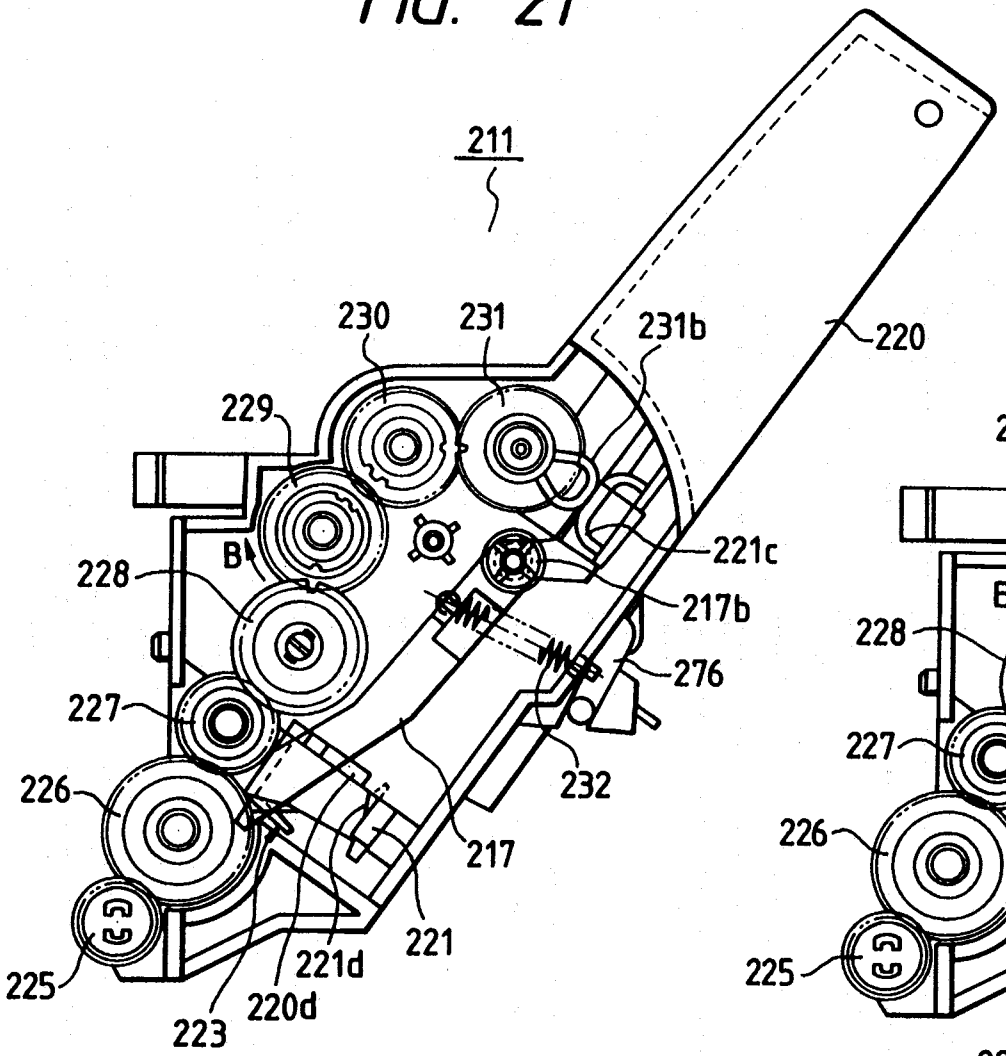

( A ) Sheet Supply Portion:

FIG. 19 is a front view of the sheet supply portion 211, and FIGS. 20 to 22 are side view of the sheet supply portion. The sheet supply portion 211 has a pressure plate (stacking means) 221 on which sheets P are stacked, and sheet supply rotary members 205 for supplying the sheet P. A movable guide 219 is slidably mounted on the pressure plate 221 to regulate the stacking position of the sheets P. Further, a base 220 is provided on a back surface of the pressure plate 221, and, as shown in FIGS. 23 to 26, an operation lever (switching means) 233 having a release cam (abutment releasing member) 231 and a releasing cam 235 is provided on the base 220.

Further, as shown in FIGS. 18 and 21, a separating claw 217 having a free end 223 is provided on a lowermost end (for example, a lowermost position in FIG. 21) of the pressure plate 221. Incidentally, the separating claw 217 has a rotary portion 217*b* having a rotary shaft so that the separating claw is rotatable, and the free end 223 of the separating claw is biased toward the pressure plate 221 by a claw spring (biasing member) 232 arranged between the rotary portion 217*b* and the free end 223 of the separating claw 217. Further, as shown in FIG. 18, a pressure plate shaft 221*b* is provided at an upper end of the pressure plate 221, and the pressure plate 221 is connected to the base 220 via the pressure plate shaft 221*b* and is rotatable around the pressure plate shaft 221*b*. Incidentally, the pressure plate 221 is biased toward the sheet supply rotary members 205 by a pressure plate spring (stacking means biasing means) 272. Further, separation pads 273 made of material having high friction of coefficient, such as artificial leather, are disposed on the pressure plate 221 in a confronting relation to the sheet supply rotary members 205 in order to prevent the double-feed of the sheets when the number of the sheets P on the pressure plate is decreased.

Further, the sheet supply rotary members 205 are supported by the base 220 at their both ends so that the sheet supply rotary members are rotatable, and a driving force from a convey roller 236 is transmitted to the sheet supply rotary members 295 via drive gears 225–230. Incidentally, each sheet supply rotary member 205 is made from one piece plastic molded part comprising a shaft portion 205*b* and a roller portion 205*c*, and a rubber layer 267 is formed around the roller portion 205*c* for supplying and feeding the sheet P. A sheet supply rotary member gear 228 is secured to the shaft portion 205*b*, and the rotational force is transmitted through this gear 228. Further, the roller portion 205*c* has a D-shaped (or semi-circular) cross-section, and a small roller 205*d* having a diameter smaller than that of the corresponding the rubber layer 267 by 0.5–3.0 mm is arranged at the outer side of each roller portion 205*c*. By these rollers 205*d*, the contamination of the image and the discrepancy in position of the sheet P are prevented due to the contact between the sheet P and the rubber layers 267 of the sheet supply rotary members 205 in operative condition.

Further, two roller portions 205*c* are provided, and these roller portions are spaced apart from a sheet reference PKO by about 40 mm and about 170 mm, respectively. With this arrangement, when the sheet P has A4 size, it is fed by the two roller portions 205*c*; whereas, when the sheet P has a smaller size such as a post card, it is fed by the single roller portion 205*c* near the sheet reference PKO. A sensor plate 269 having a diameter smaller than that of the rubber layer 267 of the sheet supply rotary member 205 is attached to the shaft portion 205*b*. The sensor plate 269 has a notch so that, only when the pressure plate 221 is in a release position or waiting position (FIG. 18) to release the abutment between the sheet P and the sheet supply rotary members 205 and the release cam 231, a roller sensor 271 comprising a photo-interrupter provided on an electric substrate 270 can receive light from a light source. Accordingly, by detecting the condition of the sensor plate 269, it is possible to detect the angular position of the sheet supply rotary members 205 and the angular position of the release cam 231 having the same phase as that of the sheet supply rotary member 205, thereby obtaining the timing of the control of the sheet supply sequence for the sheets P. Further, the sheet supply portion 211 having the above-mentioned construction is attached to the body of the recording system 1 at an angle of 30–60 degrees.

With the arrangement as mentioned above, in the waiting condition, the release cam 231 urges a push-down portion (release member) 221*c* of the pressure plate 221 downwardly (FIG. 21). Thus, the abutment between the sheets stack P rested on the pressure plate 221 and the sheet supply rotary members 205 is released. In this waiting condition, when the driving force of the convey roller 236 is transmitted to the sheet supply rotary members 205 and the release cam 231 via the gears 225–230, the release cam 231 is separated from the push-down portion 221*c* of the pressure plate 221, with the result that the pressure plate 221 is lifted, thus urging the separating claw 217 provided at the lower portion of the pressure plate 221 against the sheet stack P. At the same time, the sheet supply rotary members 205 are contacted with the sheet stack P, so that the sheets P can be picked up and supplied by the rotation of the sheet supply rotary members 205. The sheets P are separated one by one by the separating claw 217, and the separated sheet is supplied to the sheet feeding portion 212. Further, the sheet supply rotary members 205 and the release cam 231 are rotated (by one revolution) until the sheet P is sent to the sheet feeding portion 212, and are returned again to the waiting position where the abutment between the sheet supply rotary members 205 and the sheet stack P is released, with the result that the driving force of the sheet supply rotary members 205 does not act on the sheet stack P.

Further, as mentioned above, since the movable guide or variable side cover 219 is provided on the presure plate 221, a side edge (left side in FIG. 19) of the sheet stack P is regulated by the variable side cover 219 and the other side edge (right side in FIG. 19) of the sheet stack is regulated by the sheet reference PKO. Thus, even when sheets P having different side are used, the stacking position of the sheets can be regulated.

(B) Sheet Feeding Portion:

The sheet feeding portion 212 (FIGS. 18 and 19) includes the convey roller 236 for feeding the sheet P, and a PE sensor 242. A pinch roller 237 having a pinch roller guide 239 is abutted against the convey roller 236. By biasing the pinch roller guide 239 by a pinch roller spring 240, the pinch roller 237 is urged against the convey roller 236, thereby providing a feeding force for the sheet P. Further, a platen 246 and an upper guide 245 for guiding the sheet P are arranged at an inlet portion 207 (FIG. 18) of the sheet feeding portion 212 into which the sheet P is supplied. Furthermore, a PE sensor 241 is disposed above the upper guide 245. In addition, a recording head 249 for forming an image in response to image information is arranged behind (left in FIG. 18) the convey roller 236.

With this arrangement, the sheet P supplied to the sheet feeding portion 212 is guided by the platen 246, pinch roller guide 239 and upper guide 245 to be sent to a nip between the convey roller 236 and the pinch roller 237. In this case, the PE sensor 241 detects a leading end of the fed sheet P, thereby determining a print position (recording position) for the sheet P. Further, the sheet P is moved on the platen 246 by rotating the paired rollers 236, 237 by means of an LF motor 247 (FIG. 17).

Incidentally, the recording head 249 is an ink jet recording head which can easily be exchanged and which is provided with electro-thermal converters (not shown) integrally formed with an ink tank. In the recording head 249, heat is applied to ink by the electro-thermal converters. The ink is heated up to the film boiling temperature by the heat, and the ink is discharged from discharge openings (not shown) of the recording head 249 by the pressure change caused the growth and contraction of bubbles due to the film boiling, thereby forming an image on the sheet P.

(C) Carriage Portion:

The carriage portion 215 ( FIG. 17 ) includes a carriage 250 on which the recording head 249 is mounted. The carriage 250 is supported by a guide shaft 251 for causing the carriage to reciprocally scan in a direction transverse to the sheet feeding direction and a guide 252 for holding a rear end of the carriage 250 and for maintaining a gap between the recording head 249 and the sheet P. Incidentally, the guide shaft 251 and the guide 252 are attached to a housing 203. Further, the carriage 250 is driven by a carriage motor 253 attached to a lower portion (right lower portion in FIG. 17) of the housing 203, via a timing belt 255. The timing belt 255 is supported by an idle pulley 256 which can apply a tension force to the timing belt 255. Further, the carraige 250 has a flexible cable 257 for transmitting a head drive signal from the electric substrate to the recording head 249.

With this arrangement, when the image is to be formed on the sheet P, the sheet P is fed to a line position (position regarding the sheet feeding direction) where the image is formed, by the paired rollers 236, 237, and the carriage 250 is shifted to a row or column position (position perpendicular to the sheet feeding direction) where the image is formed, by the carriage motor 253, thereby opposing the recording head 249 to the recording position. Thereafter, in response to the signal from the electric substrate 270, the recording head 249 discharges the ink toward the sheet P, thereby forming the image on the sheet.

(D) Sheet Discharge Portion (mainly referred to FIG. 18):

The sheet discharge portion 213 has a transmission roller 260 abutted against the convey roller 236. Further, the transmission roller 260 is also abutted against sheet discharge rollers 259 against which spur rollers 261 are abutted, so that a nip is formed between each sheet discharge roller 259 and each spur roller 261. Further, a sheet discharge tray 262 (FIG. 17) is disposed at a downstream side of the sheet discharge rollers 259 in the sheet feeding direction. The driving force of the convey roller 236 is transmitted to the sheet discharge rollers 259 through the transmission roller 260. Further, the spur rollers 261 can be driven by the rotation of the sheet discharge rollers 259.

With this arrangement, the sheet P on which the image was formed at the carriage portion 215 is pinched by the nips between the sheet discharge rollers 259 and the spur rollers 261 and then is discharged onto the sheet discharge tray 262.

(E) Cleaning Portion:

The cleaning portion 216 (FIG. 17) includes a pump 263 for cleaning the recording head 249, a cap 265 for preventing the recording head 249 from drying, and a drive switching arm 266 for switching the driving force of the convey roller 236 to the sheet supply portion 211 or to the pump 263. When the cleaning operation is not effected, the drive switching arm 266 is in a position shown in FIG. 17, where a planetary gear (not shown) rotated around an axis of the convey roller 236 is secured at a predetermined position. Further, .when the drive switching arm 266 is shifted in a direction shown by the arrow A by shifting the carriage 250, the planetary gear is rotated in response to the normal rotation or the reverse rotation of the convey roller 236, so that, when the convey roller 236 is rotated normally, the driving force is transmitted to the sheet supply portion, and, when the convey roller 236 is rotated reversely, the driving force is transmitted to the pump 263.

The above arrangement will be further fully explained (mainly, with reference to FIGS. 17 and 20 to 22).

As mentioned above, when the drive switching arm 266 of the cleaning portion 216 is shifted in the direction A by shifting the carriage 250 and the convey roller 236 is rotated normally, the planetary gear is shifted. As a result, the planetary gear is engaged by an input gear 225, thus transmitting the driving force to the sheet supply rotary member gear 228 fixed to the sheet supply rotary members 205 via idler gears 226, 227 thereby to rotate the sheet supply rollers 205. Further, the driving force is transmitted from the sheet supply rotary member gear 228 to the release cam 231 via a clutch gear 229 and an idler gear 230. In this case, since the sheet supply rotary members 205 and the release cam 231 have the same phase for each revolution, in the waiting position as shown in FIGS. 18 and 21, each sheet supply rotary member 205 having a semi-circular portion (having a center angle of about 120°) is not abutted against the sheet stack P but is merely opposed to it. However, in the sheet supply condition, the sheet supply rotary members 205 are abutted against the sheet stack P with an abutment pressure of 200–500 grams.

Further, the release cam 231 urges the push-down portion 221*c*, thereby bringing the pressure plate 221 to the waiting position. In this case, a pressure plate cam 276 atached to the base 220 is pushed down by a cam 221*d* formed on the pressure plate 221. When the pressure plate cam 276 is pushed down, a shaft 276*b* is rotated to Simultaneously rotate a pressure plate cam 276*a* attached to the other end of the shaft. This pressure plate cam 276*a* is engaged by the pressure plate 221, and when rotated, lowers the pressure plate. Accordingly, even when the push-down portion 221*c* is urged downwardly, the pressure plate 221 is not inclined with respect to the base 220, and is lowered while always keeping the parallelism regarding the base.

Further, a clutch spring 277 (FIG. 19) is arranged within the clutch gear 229 so that the clutch spring 277 is tightened when the clutch gear is rotated in a direction shown by the arrow B (FIG. 21). Thus, the rotation of the clutch gear in the direction B is regulated, thereby preventing the reverse rotation of the sheet supply rotary members 205. Consequently, in the registration operation, even when the force is applied from the sheet P to the sheet supply rotary members 5 in the reverse direction, the sheet supply rotary member 205 does not rotate, thereby permitting the good registration operation.

Further, as mentioned above, the separating claw 217 can be rotated around the rotary portion 217*b*, and can be urged against the sheet stack P or the pressure plate 221 by the claw spring 232 with a force of 20–100 grams. The separating claw 217 serves to separate the sheets when the sheets P such as normal sheets are used, and, as shown in FIG. 19, the separating claw is arranged only at the side of the sheet reference PKO. The separating claw has a shape to cover a front corner of the sheet stack P with a triangular manner (for example see FIG. 23). The sheets P can be separated one by one by the resistance of this triangular portion. Further, a claw slide spring 235′ (FIGS. 23 and 24) is provided around the rotary portion 217*b* of the separating claw 217, which spring biases the separating claw 217 toward a direction (for example, right in FIG. 24) that the separating claw 217 is drawn from the rotary portion 217*b*. Further, on the release cam 231, there is provided a claw cam (regulating means) 231*b* for rotating the separating claw (for example, in a direction perpendicular to a plane of FIG. 24) other than the waiting position of the pressure plate 221.

The operation lever 233 Can be shifted between (i) a normal sheet feed position, and (ii) a thick sheet feed position (FIG. 20), and these positions are angularly spaced apart from each other by an angle of about 20°–50°. Now, the operation in (i) and (ii) positions will be explained.

Figure 23:
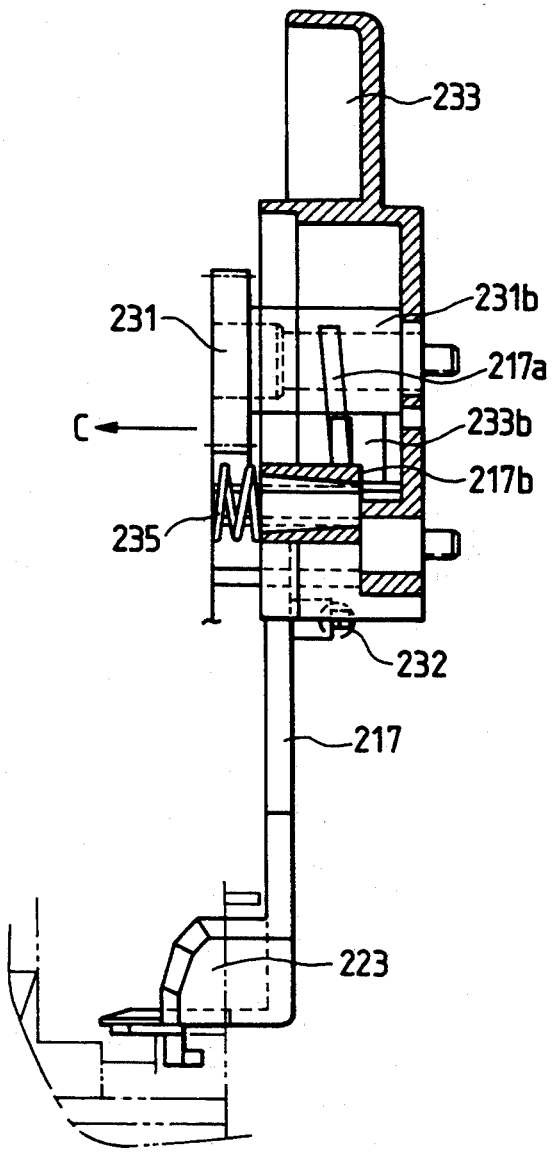
FIGS. 23 and 24 are side views of a switching means of the sheet supplying apparatus of FIG. 19.
Figure 24:
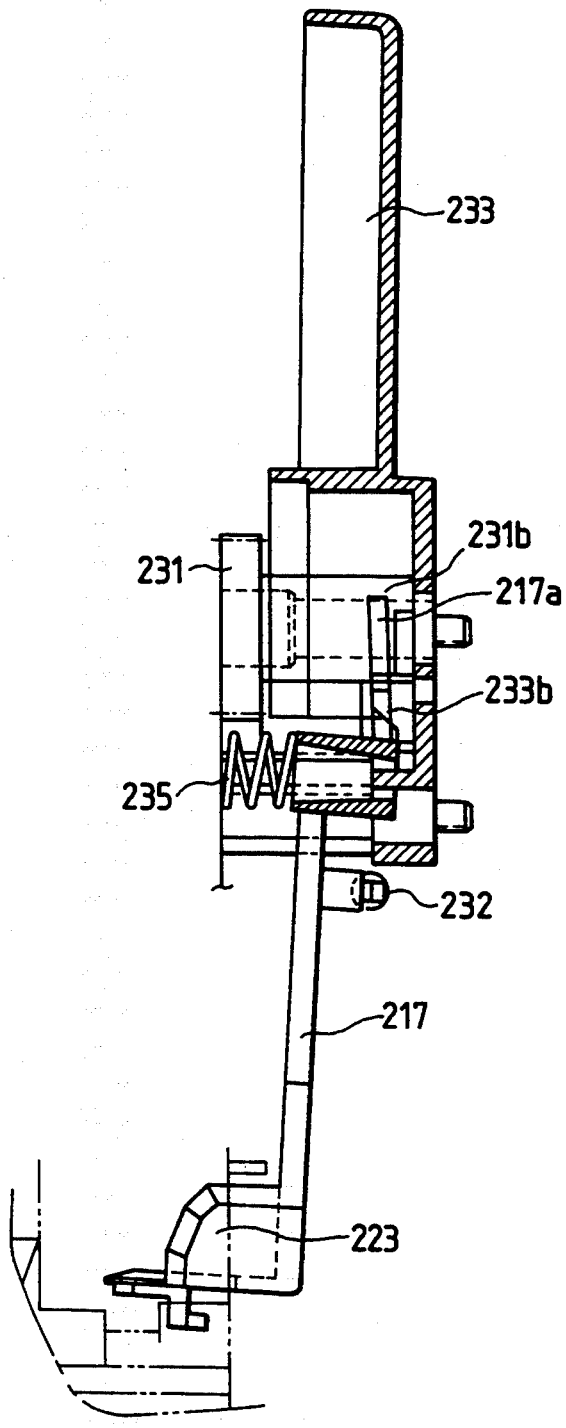
Figure 25:
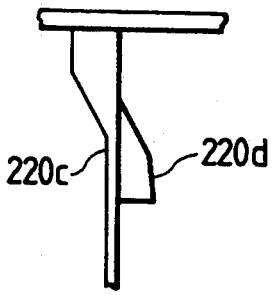
FIG. 25 is a partial front view of a separation means of the sheet supplying apparatus of FIG. 19.
Figure 26:
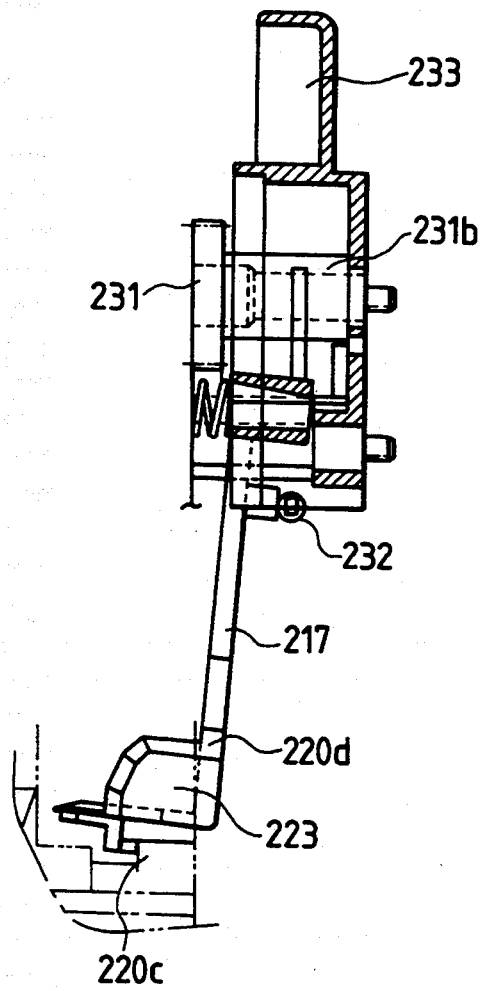
FIG. 26 is a side view of the switching means of the sheet supplying apparatus of FIG. 19.

(i) Normal Sheet Feed Position:

When the operation lever 233 is rotated in the normal sheet feed position (in FIG. 24, the operation lever is pushed from this side to that side to change the lever from a condition shown in FIG. 24 to a condition shown in FIG. 23), a cam 233*b* formed on the operation lever 233 is rotated to push a base portion 217*a* of the separating claw 217 axially (in a direction shown by the arrow C in FIG. 23). Consequently, the separating claw 217 is slid. Incidentally, in this condition, the base portion 217*a* of the separating claw 217 can act on the claw cam 231*b*. In this condition, when the pressure plate 221 is pushed down to assume the waiting position, the separating claw 217 is rotated by the claw cam 231*b*, with the result that the free end 223 of the separating claw 217 is shifted upwardly (toward this side in FIG. 23). Accordingly, the separating claw 217 is separated from the sheet stack P. Thus, in the waiting condition, the sheets P can merely be loaded on the sheet stacking means without any operation for releasing the abutment between the separating claw 217 and the sheet stack P.

Further, in the above-mentioned waiting condition, when the sheet supply rotary members 205 are rotated to start the sheet supplying operation, the driving force is transmitted to the release cam 231 to rotate it, thereby disengaging the release cam 231 from the push-down portion 221*c* to release the waiting condition. Consequently, the sheet supply rotary members 205 are abutted against the sheet stack P. In this case, since the claw cam 231*b* which has lifted the separating claw 217 Upwardly is also rotated in synchronous with the rotation of the sheet supply rotary members, the separating claw 217 is abutted against the sheet stack P, thereby permitting the separation and supply of the sheets one by one.

(ii) Thick Sheet Feed Position:

By setting the operation lever 233 to the thick sheet feed position, the cam 233*b* is rotated to separate the separating claw 217 from the sheet stack P. At the same time, the separating claw 217 is pushed by the claw slide spring 235′0 to be drawn from the rotary portion (thereby, changing the condition from that shown in FIG. 23 to that shown in FIG. 24). In this position, since the separating claw 217 is not influenced upon the action of the claw cam 231*b*, the separating claw 217 is biased toward the pressure plate 221 by the claw spring 232 (FIG. 22). Incidentally, a projection (first locking member) 221*d* (FIGS. 18, 20 and 22) is disposed above an abutment area between the separating claw 217 and the pressure plate 221 so that, when thick sheets P are loaded, the separating claw 217 is prevented from entering inwardly (for example, that side in FIG. 18 in a widthwise direction of the sheet). Accordingly, when the thick sheets P are supplied, the separating claw 217 is not biased by the sheet stack P and is abutted against a lower guide portion 220*b* of the base 220. Further, during the sheet supplying operation, since the separating claw 217 is not used, the sheets P are separated and supplied one by one by utilizing the friction force between the sheet and the separation pad 273 formed on the pressure plate 221.

Further, when a sheet is manually supplied one by one, such manual sheet supply is effected in the thick sheet feed position (ii). In the thick sheet feed position, the manually supplied sheet P may be inserted between the pinch roller 237 and the convey roller 236. As a result, the sheet passes across the PE sensor lever 241, thus turning the PE sensor 242 ON. Thereafter, when a predetermined time period (1–2 seconds) is elapsed, an operation for registering the leading ends of the sheets is effected, thus preparing for waiting a print signal.

Further, if the manually supplied sheet is inserted in the normal sheet feed position in which the normal sheets are set, the inserted sheet will be caught by the separating claw 217. Therefore, in the manual sheet insertion, the insertion of the sheet can be facilitated by changing the condition to the thick sheet feed position to bias the separating claw 217 toward the pressure plate 221 thereby preventing the interference between the inserted sheet and the separating claw. In this case, the practical and constructural advantage that there is no need to provide a sheet supply opening only for the manual sheet insertion can be obtained.

Further, in some cases, the leading ends of the sheets P reach up to the lower guide portion 220*b* regarding the pressure plate 221 in the waiting condition. In this condition, if the operation lever 233 is switched from the normal sheet feed position to the thick sheet feed position for the manual sheet insertion, thereby biasing the separating claw 217 toward the pressure plate 217, the front corners of the sheet stack P will be bent or deformed by the biasing force of the separating claw 217. This is noticeable particularly when the number of the sheets is few. Since the engagement amount between the separating claw 217 and the sheet stack P is normally set to 3–5 mm in consideration of the large number of sheets, if such a condition occurs, the separating claw 217 will be disengaged from the sheet stack P to make the separating claw inoperative, thus causing the double-feed or poor feeding. To avoid this, in the illustrated embodiment, the pivot shaft for the separating claw 217 is tapered to make the free end of the separating claw 217 rockable and guide portions (shift regulating members) 220*c*, 220*d* are provided on the base 220 (FIGS. 25 and 27), thereby increasing the engagement amount between the separating claw and the sheet stack P to 8–10 mm.

Figure 27A:
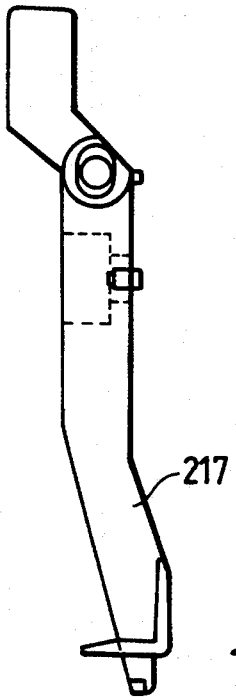
FIG. 27A is a partial side view of the separation means of the sheet supplying apparatus of FIG. 19.
Figure 27B:
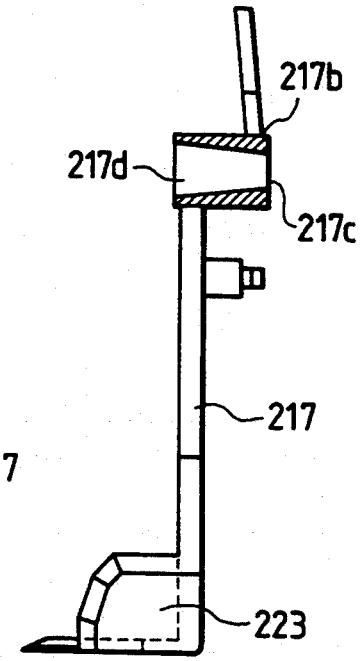
FIG. 27B is a front view of the separation means.

With this arrangement, it is possible to prevent the separating claw 217 from being disengaged from the sheet stack P. The tapered configuration is defined by a tapered bore extending between a reference circular hole (smaller diameter hole portion) 217*c* and an elongated slot hole (larger diameter hole portion) 217*d* (FIG. 27). The rocking direction of the separating claw is regulated by the elongated slot hole 217*d*, thereby preventing the double-feed of the sheets during the sheet separation.

Incidentally, the above-mentioned gears, separating claw 217, operation lever 233 and the like (except sheet supply rotary member shaft 279) are rotatably mounted on shafts arranged on a right side plate of the base 220.

Next, a further embodiment of the present invention will be explained with reference to FIG. 28. Incidentally, since a recording system having a sheet supplying apparatus according to this embodiment is substantially the same as that of the previous embodiment, the same constructural elements will be designated by the same reference numerals, and only the difference will be described.

In the previous embodiment, when the operation lever 233 is shifted to the normal sheet feed position, the separating claw 217 are pushed in by the cam 233*b* of the operation lever 233 in the axial direction while rotating, so that the separating claw is shifted to the position where the claw cam 231*b* of the release cam 231 can act on the separating claw. When the pressure plate 221 is in the waiting position, the separating claw 217 is shifted upwardly by the claw cam 231*b*.

Figure 28:
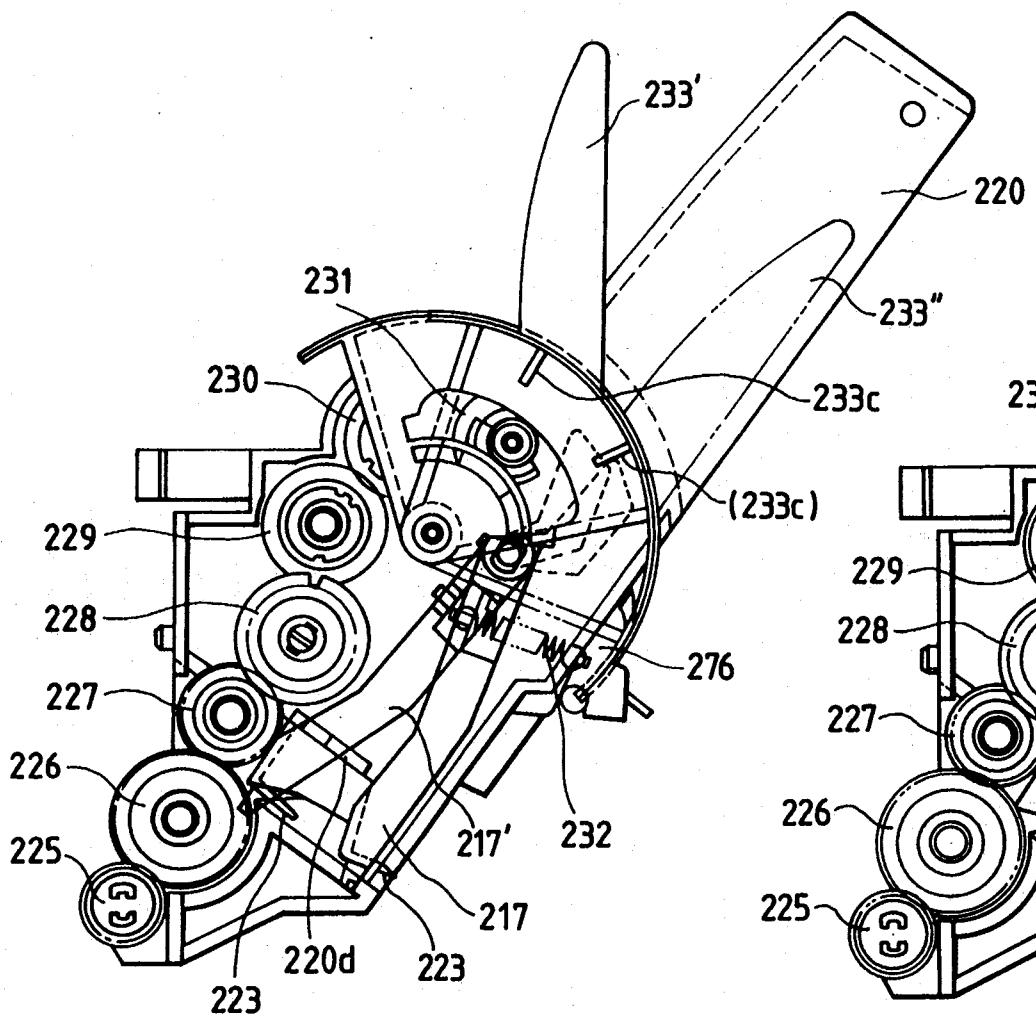
FIG. 28 is a side view of a switching means of a sheet supplying apparatus according to a still further embodiment of the present invention.

However, in this embodiment, as shown in FIG. 28, the shifting range of the separating claw 217 is limited by a stopper (shifting range regulating member) 233*c* formed on the operation lever 233. When the operation lever 233 is in the normal sheet feed position (shown as operation lever 233' in FIG. 28), the stopper 233*c* is spaced apart from the free end 233 of the separating claw 217 greatly, so that the free end 233 of the separating claw 217 can freely move toward the pressure plate 221 under the biasing force of the claw spring 232. On the other hand, when the operation lever is in the thick sheet feed position (shown as operation lever 233'' in FIG. 28), the stopper 233*c* regulates the free end of the separating claw 217, thereby separating the free end 233 of the separating claw 217 from the pressure plate 221 greatly (in this condition, the separating claw is shown as separating claw 217' in FIG. 28).

Consequently, the separating claw 217 is moved together with the operation lever 233, thereby preventing the interference between the separating claw 217 and the sheet even when the thick sheets are supplied. Accordingly, in comparison with the previous embodiment, this embodiment has an advantage that the claw cam 231*b* of the release cam 231 and the claw slide spring 235 can be omitted.

A still further embodiment of the present invention will be explained with reference to FIG. 29.

In the previous embodiment, when the operation lever is in the thick sheet feed position, the separating claw 217 is biased toward the pressure plate 221, so that, when the thick sheets are loaded, the separating claw 217 does not shift toward the sheet stack P by providing the projection 221*d* above the separating claw 217.

Figure 29:
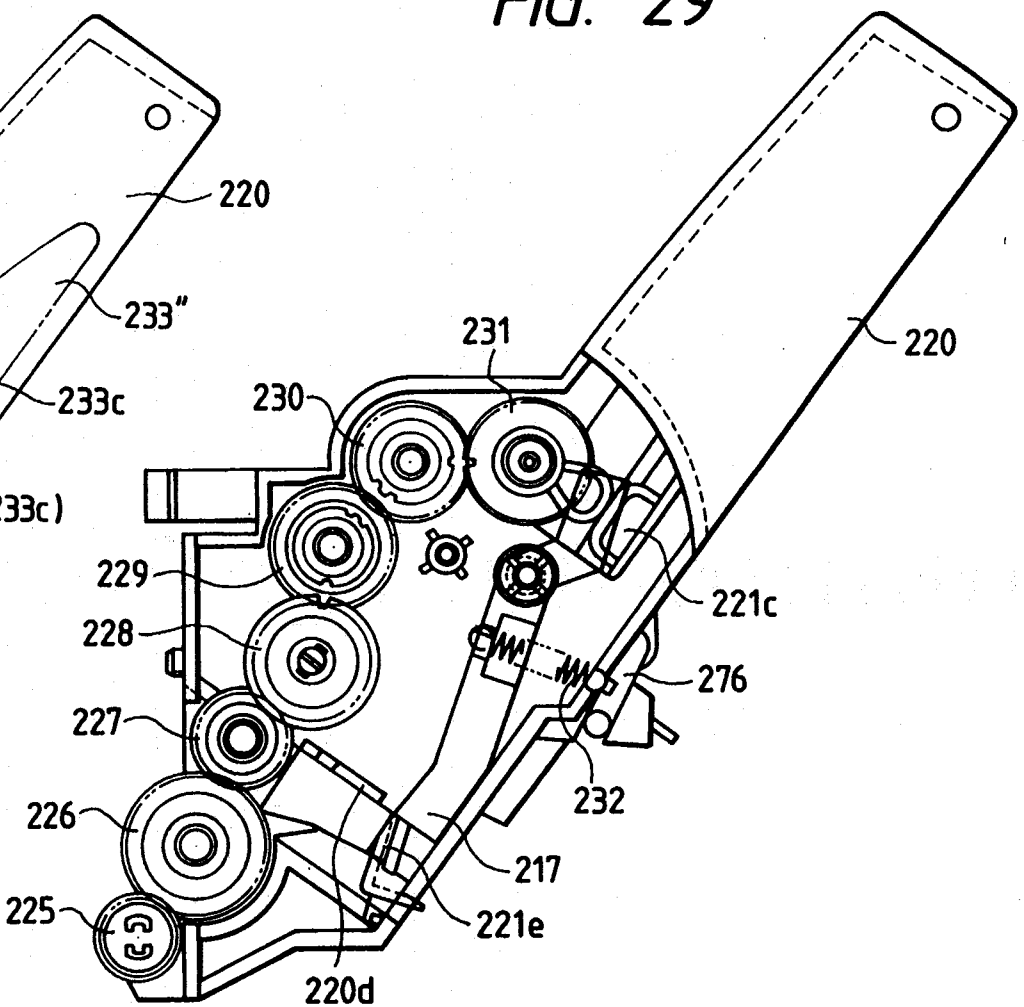
FIG. 29 is a side view of a switching means of a sheet supplying apparatus according to a further embodiment of the present invention.

However, in this embodiment, as shown in FIG. 29, a recessed portion (second locking member) 221*e* is formed on a corner of the pressure plate 221, so that, when the thick sheets P are loaded, the separating claw 217 is escaped in the recessed portion, thereby preventing the separating claw from shifting toward the sheet stack P. In this case, since the projection can be omitted, the stacking amount of the sheets can be increased accordingly.

A further embodiment of the present invention will be explained with reference to FIGS. 30 to 33.

In the previous embodiment, while the separating claw 217 was shifted, by the cam 233*b* of the operation lever 233, to the position where the claw cam 231*b* of the release cam 231 did not act on the separating claw 217, as shown in FIGS. 30 to 33, a claw cam (separating means shifting member) 231*c* shiftable only in an axial direction of the release cam 231 may be provided so that this claw cam can act on the separating claw 217 by shifting the former. The details will be described hereinbelow.

Figure 30:
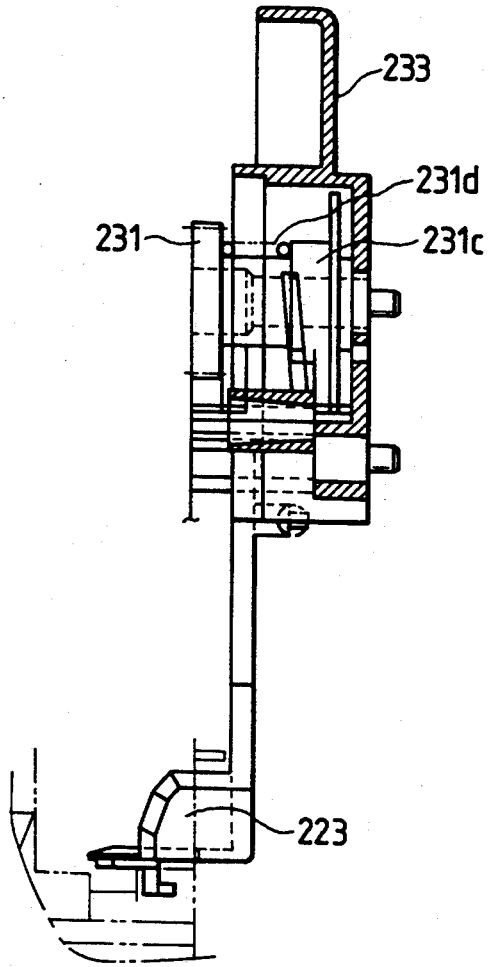
FIG. 30 is a side view of a switching means of a sheet supplying apparatus according to still further embodiment of the present invention.
Figure 32:
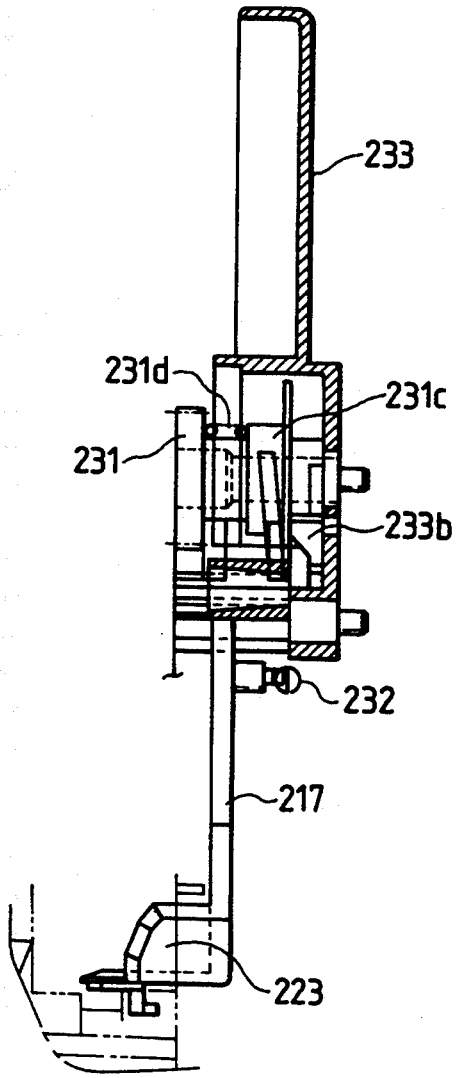
FIG. 32 is a side view of the switching means of the sheet supplying apparatus of FIG. 30.
Figure 31:
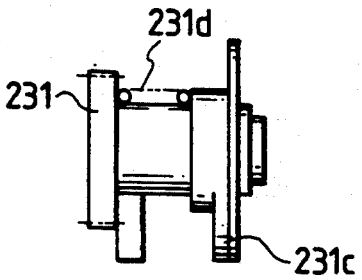
FIG. 31 is a partial side view of the switching means of FIG. 30.
Figure 33:
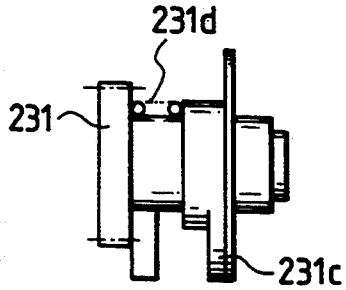
FIG. 33 is a partial side view of the switching means of FIG. 32.

The claw cam 231*c* is shiftable only in the axial direction of the release cam 231 and is biased toward an inner wall of the operation lever 233 by a spring (shift biasing member) 231*d*. In this case, the phase between release cam 231 and the claw cam 231*c* is set to a predetermined relation so that the release of the separating claw 217 and that of the pressure plate 221 are timed. FIGS. 30 and 31 show the thick sheet feed position where, since the claw cam 231*c* is biased outwardly (right in FIG. 30) by the spring 231*d*, the claw cam 231*c* does not act on the separating claw 217. On the other hand, FIGS. 32 and 33 show the normal sheet feed position where the claw cam 231*c* is pushed inwardly (left in FIG. 32) by the cam 233*b* of the operation lever 233. Thus, the claw cam 231*c* can act on the separating claw 217.

Incidentally, with this arrangement, the switching position for the operation lever 233 is reverse to that of the previous embodiment (the normal sheet feed position and the thick sheet feed position in FIG. 20 are reversed). The action of the claw cam 231*c* on the separating claw 217 and others are the same as those in the previous embodiment.

A still further embodiment of the present invention will be explained with reference to FIG. 34.

Figure 34:
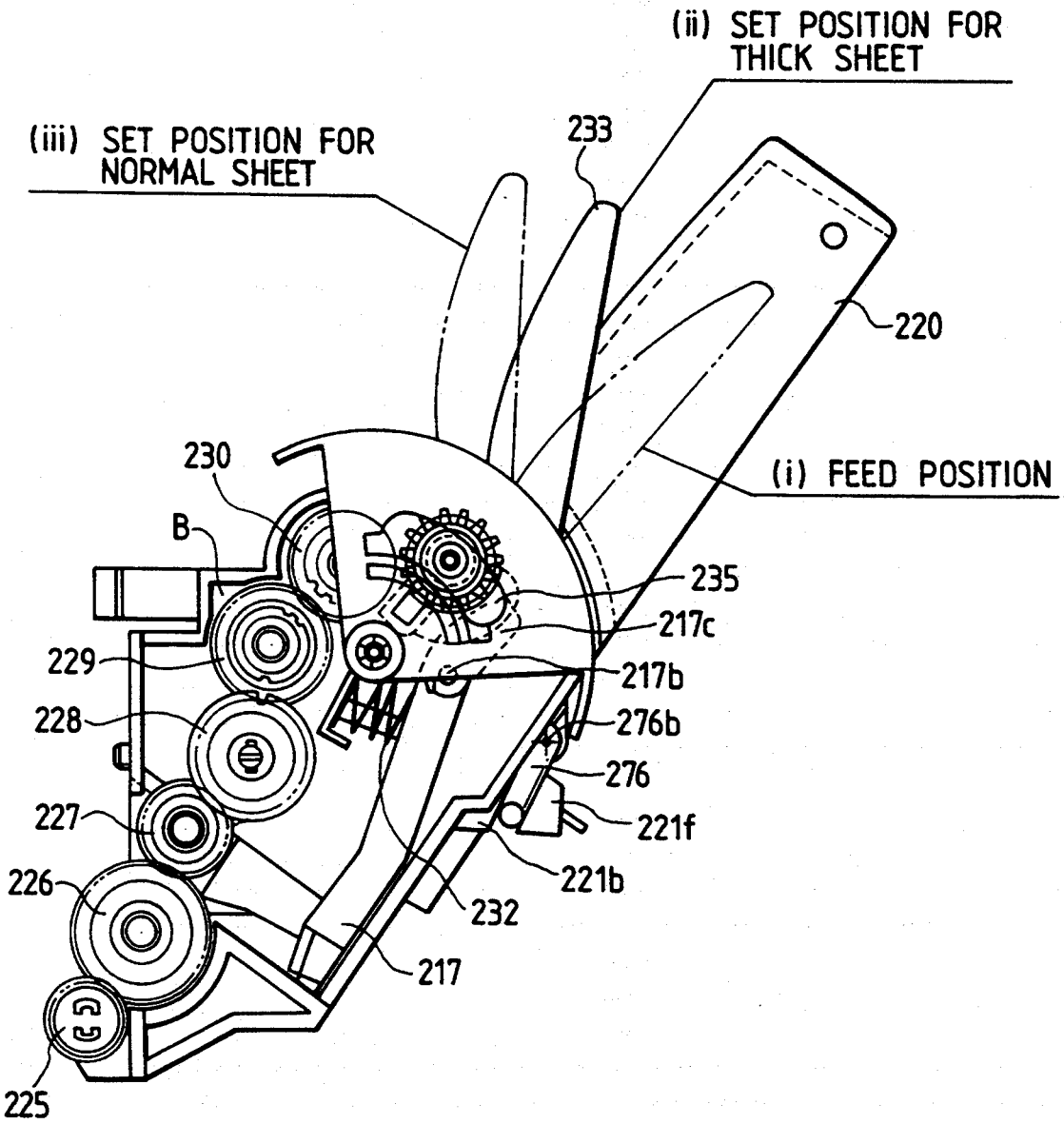
FIG. 34 is a side view of a switching means of a sheet supplying apparatus according to a further embodiment of the present invention.

In the previous embodiment, while the operation lever for designating the sheet feed position could assume two positions, as shown in FIG. 34, the operation lever may assume three positions. In this case, the release cam 231 is divided into a first release cam 231*d* for pushing down only the pressure plate 221, and a second release cam 231*c* for pushing down the pressure plate. 221 and the separating claw 217, and these cams operate independently.

The second release cam 231*c* is coaxial with the first release cam 231*d*. The operation lever 233 and the second release cam 231*c* are operated not in synchronous with but independently from the first release cam 231*d*, and are used for setting the sheets P by the operator. The operation lever 233 and the second release cam 231*c* are interconnected by gears.

Further, the operation lever 233 can assume three positions, i.e., (i) a feed position, (ii) a thick sheet set position and (iii) a normal sheet set position, and these positions are angularly spaced apart from each other by an angle of 20°–50°. A gear ratio is so set that the releasing cam 235 is rotated by 90° for each of these three positions.

In the feed position (i), the second release cam 231*c* does not act on the push-down portion 221*c* of the pressure plate 221 and the push-down portion 217*c* of the separating claw 217. During the normal sheet supply, the operation lever is in this feed position.

In the thick sheet set position (ii), since the second release cam 231*c* pushes down only the push-down portion 221*c* of the pressure plate 221, the separating claw 217 is lowered along the pressure plate 221. As a result, the thick sheets can be set without interference with the separating claw 217. Further, the manual sheet insertion is effected in this position.

In the normal sheet set position (iii), since the second release cam 231*c* pushes down both the push-down portions 221*c* of the pressure plate 221 and the push-down portion 217*c* of the separating claw 217, the separating claw 217 is lifted with respect to the pressure plate 221, with the result that the normal sheets can be set while engaging the sheets by the separating claw 217. Further, while a tension coil spring was used as the claw spring, a compression coil spring may be used.

With this arrangement, in the feed position (i), since the separating claw 217 is always biased against the sheet stack P, the claw is more likely to be disengaged from the sheet stack. Accordingly, when the pressure plate 221 is released, the effect that the engagement amount-between the separating claw 217 and the sheet stack becomes greater can be used effectively.

A further embodiment of the present invention will be explained with reference to FIGS. 35 and 36.

Figure 35:
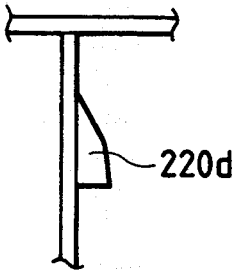
FIG. 35 is a partial front view of a separation means of a sheet supplying apparatus according to a still further embodiment of the present invention.
Figure 36:
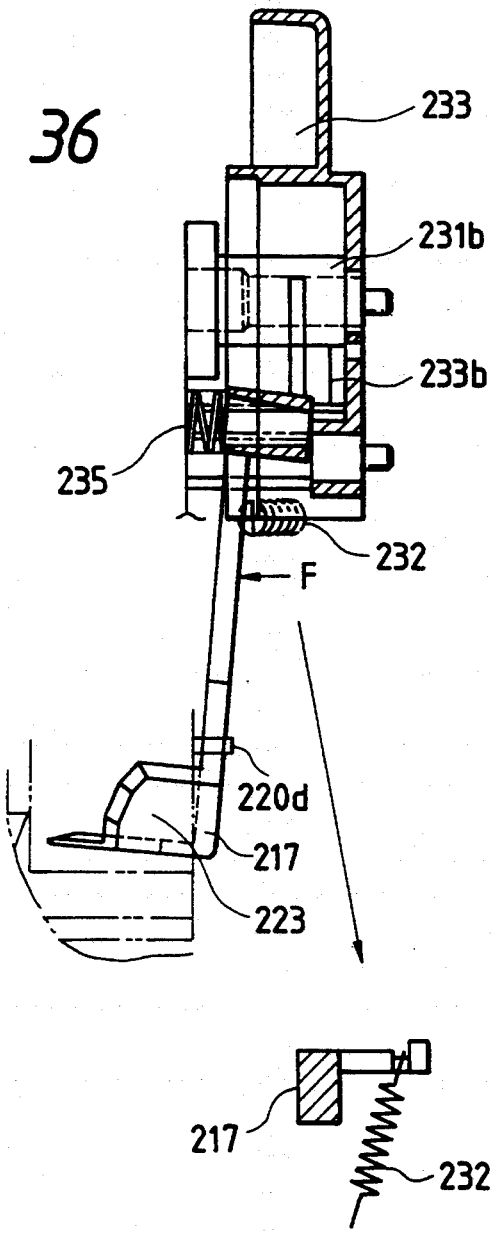
FIG. 36 is a side view of a switching means of the sheet supplying apparatus of FIG. 35.

In the previous embodiment, while the movement of the separating claw 217 was regulated by the guides 220*c*, 220*d*, as show in FIGS. 35 and 36, the separating claw may be abutted against the guide 220*d* by applying it to a force F by arranging the claw spring 232 obliquely. In this case, the separating claw can stably be moved without any play.

As mentioned above, according to the present invention, the following advantages can be obtained:

(1) When the normal sheets are set on the pressure plate, if the operation lever is in the normal sheet feed position, the sheets can be loaded on the pressure plate without driving the operation lever; and, if the operation lever is in the thick sheet feed position, the operation lever may merely be shifted to the normal sheet feed position in order to permit the loading of the normal sheets. On the other hand when the thick sheers are set on the pressure plate, if the operation lever is in the thick sheet feed position, the sheets can be loaded on the pressure plate without driving the operation lever; and, if the operation lever is in the normal sheet feed position, the operation lever may merely be shifted to the thick sheet feed position in order to permit the loading of the thick sheets. Accordingly, the labor of the operator for cocking the guide plates and the like can be omitted. Therefore, even in an automatic sheet supplying apparatus using the separating claw separation mode only by switching the operation lever, the normal sheet and the thick sheet such as a post card can be used properly. Accordingly, unlike to the prior art, any sheets can be set without being caught by the separating claw and with the easy operation.

(2) When the sheets are manually supplied one by one, if the operation lever is in the thick sheet feed position, the sheet can be inserted without driving the operation lever; and, if the operation lever is in the normal sheet feed position, the operation lever may merely be shifted to the thick sheet feed position in order to permit the manual sheet insertion.

(3) In the single side reference recording mode wherein the sheets are set on the basis of the single side reference, since any guides are not required to set the thick sheets, the thick sheet can be printed with a sheet reference same as that for the normal sheet.

(4) In the waiting condition, since it is possible to increase the engagement amount between the separating claw and the sheet stack, even when the number of sheets is decreased, the separating claw is not disengaged from the sheet stack. Further, during the sheet supplying operation, since the engagement amount between the separating claw and the sheet stack is decreased in comparison with that in the waiting condition, it is possible to separate the sheets stably and properly, thus improving the reliability of the apparatus.

(5) Since the rocking movement of the separating claw is limited by the tapered bore connecting between the circular hole and the elongated slot hole, it is possible to prevent the double-feed of the sheets, thus improving the reliability of the apparatus.

What is claimed is:

1. A sheet supplying apparatus comprising:

extendible sheet supporting means for supporting sheets;

sheet supply means for feeding out the sheets supported by said sheet supporting means;

a separating claw for separating the sheets fed by said sheet supply means one by one by engaging with a front edge of the sheets supported by said sheet supporting means, said separating claw being shiftable between a separate position for separating the sheets by engaging with the front edge of the sheets and a non-separate position not engaging with the front edge of the sheets;

shifting means for shifting said separating claw between the separate position and non-separate position, in response to extending and shortening movements of said sheet supporting means; and second separation means for separating the sheets fed out by said sheet supply means one by one when said separating claw is shifted to the non-separate position by said shifting means.

2. A sheet supplying apparatus according to claim 1, wherein said shifting means shifts said separating claw to the non-separate position adjacent to said sheet supporting means when said sheet supporting means is shortened, and the sheets are rested on said separating claw.

3. A sheet supplying apparatus according to claim 2, wherein said sheet supporting means is shortened when a thick sheet and when a small-sized sheet is loaded.

4. A sheet supplying apparatus according to claim 1, wherein, when said sheet supporting means is extended, said separating claw is spaced apart from said sheet supporting means to create a space between said separating claw and said sheet supporting means, the sheets are loaded in said space and engaged by said separating claw.

5. A sheet supplying apparatus according to claim 1, wherein said second separation means has an inclined surface crossing a feeding direction of the sheets fed by said sheet supply means, and the sheets are separated one by one when the sheet rides over said inclined surface.

6. A sheet supplying apparatus comprising:

sheet supporting means for supporting sheets;

sheet supply means for feeding out the sheets supported by said sheet supporting means;

a separating claw for separating the sheets fed by said sheet supply means one by one by engaging with a front edge of the sheets supported by said sheet supporting means, said separating claw being shiftable between a separate position for separating the sheets by engaging with the front edge of the sheets, and a non-separate position not engaging with the front edge of the sheets;

a hopper plate supported to be extended and retracted with respect to a body of the sheet supplying apparatus and capable of partially supporting the sheets supported by said sheet supporting means;

shifting means for shifting said separating claw between the separate position and the non-separate position in response to extending and retracting movements of said hopper plate; and second separation means for separating the sheets fed out by said sheet supply means one by one when said separating claw is shifted to the non-separate position by said shifting means.

7. A sheet supplying apparatus according to claim 6, wherein said shifting means shifts said separating claw to the non-separate position adjacent to said sheet supporting means when said hopper plate is shifted from an extended position to a retracted position, so that the sheets are rested on said separating claw in the non-separate position.

8. A sheet supplying apparatus according to claim 6, wherein, when said hopper plate is in an extended position, said separating claw is spaced apart from said sheet supporting means to create a space between said separating claw and said sheet supporting means, the sheets are loaded in said space and engaged by said separating claw.

9. A sheet supplying apparatus according to claim 6, wherein said hopper plate supports trailing ends of the sheets supported by said sheet supporting means when it is extended.

10. A sheet supplying apparatus according to claim 6, wherein when said hopper plate is retracted, said sheet supporting means is capable of supporting a thick sheet and a small-sized sheet.

11. A sheet supplying apparatus according to claim 10, wherein said shifting means has a rockable regulating lever for regulating said separating claw to a regulated position spaced apart from said sheet supporting means, said regulating lever being provided with a cam portion engageable with said hopper plate means so that, when said hopper plate is retracted and is engaged by said cam portion, said cam portion rocks said regulating lever to shift said separating claw from said regulated position toward said sheet supporting means.

12. A sheet supplying apparatus according to claim 6, wherein said second separation means has an inclined surface crossing a feeding direction of the sheets fed by said sheet supply means, and the sheets are separated one by one when the sheet rides over said inclined surface.

13. A sheet supplying apparatus comprising:

sheet supporting means for supporting sheets, and shiftable between a sheet supply position and a waiting position;

sheet supply means for feeding out of sheets supported by said sheet supporting means at a sheet supply position;

a separating claw for separating the sheets fed by said sheet supply means one by one by engaging with front corners of the sheets supported by said sheet supporting means, said separating claw being shiftable between a separate position for separating the sheets by engaging with a front edge of the sheets, and a non-separate position not engaging with the front edge of the sheets;

a hopper plate to be extended and retracted with respect to a body of the sheet supplying apparatus and capable of partially supporting the sheets supported by said sheet supporting means;

switching means for switching positions of said hopper plate and for shifting said sheet supporting means between the sheet supply position and the waiting position;

shifting means for shifting said separating claw between the separate position and the non-separate position in response to extending and retracting movements of said hopper plate by said switching means; and second separation means for separating the sheets fed out by said sheet supply means one by one when said separating claw is shifted to the non-separate position by said shifting means.

14. A sheet supplying apparatus according to claim 13, wherein, when said hopper plate is shifted from an extended position to an inserted position by said switching means, said switching means shifts said sheet supporting means, from the sheet supply position to the waiting position, and said shifting means shifts said separating claw from the separate position to the non-separate position.

15. A sheet supplying apparatus according to claim 14, wherein said sheet supporting means comprises a rockable pressure plate, and an elastic member for biasing said pressure plate toward said sheet supply means.

16. A sheet supplying apparatus according to claim 15, wherein said switching means comprises a rockable switching lever which has projection for pushing down said pressure plate in opposition to a biasing force of said elastic member, and an engagement member which engages said hopper plate to shift it.

17. A sheet supplying apparatus according to claim 16, where in said shifting means has a rockable regulating lever for regulating said separating claw to a regulated position spaced apart from said sheet supporting means, said regulating lever being provided with a cam portion engageable with said hopper plate so that, when said hopper plate is retracted and is engaged by said cam portion, said cam portion rocks said regulating lever to shift said separating claw from said regulated position toward said sheet supporting means.

18. A sheet supplying apparatus according to claim 13, wherein said second separation means has an inclined surface crossing a feeding direction of the sheets fed by said sheet supply means, and the sheets are separated one by one when the sheet rides over said inclined surface.

19. An image forming apparatus comprising:

extendible sheet supporting means for supporting sheets;

sheet supply means for feeding out the sheets supported by said sheet supporting means;

a separating claw for separating the sheets fed by said sheet supply means one by one by engaging with front edges of the sheets supported by said sheet supporting means, said separating claw being shiftable between a separate position for separating the sheets by engaging with a front edge of the sheets, and a non-separate position not engaging with the front edge of the sheets;

shifting means for shifting said separate claw between the separate position and non-separate position, in response to extending and shortening movements of said sheet supporting means;

second separation means for separating the sheets fed out by said sheet supply means one by one when said separating claw is shifted to the non-separate position by said shifting means; and image forming means for forming an image on the sheet separated and fed by said separating claw when said separating claw is in the separate position and said second separation means when said separating claw is in the non-separate position.

20. An image forming apparatus comprising:

sheet supporting means for supporting sheets;

sheet supply means for feeding out the sheets supported by said sheet supporting means;

a separating claw for separating the sheets fed by said sheet supply means one by one by engaging with front edges of the sheets supported by said sheet supporting means, said separating claw being shiftable between a separate position for separating the sheets by engaging with a front edge of the sheets, and a non-separate position not engaging with the front edge thereof;

a hopper plate supported to be extended and retracted with respect to a body of the sheet supplying apparatus and capable of partially supporting the sheets supported by said sheet supporting means;

shifting means for shifting said separating claw between the separate position and the non-separate position in response to extending and retracting movements of said hopper plate; and second separation means for separating the sheets fed out by said sheet supply means one by one when said separating claw is shifted to the non-separate position by said shifting means; and image forming means for forming an image on the sheet separated and fed by said separating claw when said separating claw is in the separate position and said second separation means when said separating claw is in the non-separate position.

21. An image forming apparatus comprising:

sheet supporting means for supporting sheets and shiftable between a sheet supply position and a waiting position;

sheet supply means for feeding out of sheets supported by said sheet supporting means at a sheet supply position;

a separating claw for separating the sheets fed by said sheet supply means one by one by engaging with front corners of the sheets supported by said sheet supporting means, said separating claw being shiftable between a separate position for separating the sheets by engaging with a front edge of the sheets, and a non-separate position not engaging with the front edge of the sheets;

a hopper plate to be extended and retracted with respect to a body of the sheet supplying apparatus and capable of partially supporting the sheets supported by said sheet supporting means;

switching means for switching positions of said hopper plate and for shifting said sheet supporting means between the sheet supply position and the waiting position;

shifting means for shifting said separating claw between the separate position and the non-separate position in response to extending and retracting movements of said hopper plate by said switching means; and second separation means for separating the sheets fed out by said sheet supply means one by one when said separating claw is shifted to the non-separate position by said shifting means; and image forming means for forming an image on the sheet separated and fed by said separating claw when said separating claw is in the separate position and said second separation means when said separating claw is in the non-separate position.

* * * * *

UNITED STATES PATENT AND TRADEMARK OFFICE

CERTIFICATE OF CORRECTION

PATENT NO. : 5,437,444
DATED : August 1, 1995
INVENTOR(S) : HIDEAKI KAWAKAMI, ET AL.

It is certified that error appears in the above-identified patent and that said Letters Patent is hereby corrected as shown below:

ON TITLE PAGE

In [30] Foreign Application Priority Data, insert:
--Feb. 5, 1993 [JP] Japan ..... 5-041877--.

In [57] ABSTRACT:
Line 6, "from" should read --front--.
Line 9, "insert" should read --inserting--.

COLUMN 1

Line 15, "separation" should read --separation,--.
Line 65, "size" should read --size,--.

COLUMN 10

Line 33, ".when" should read --when--.

COLUMN 11

Line 4, "Simultaneously" should read --simultaneously--.
Line 46, "Can" should read --can--.

COLUMN 12

Line 13, "Up-" should read --up- --.
Line 23, "spring 235'0" should read --spring 235'--.
Line 24, "(thereby," should read --(thereby--.

COLUMN 13

Line 65, "lever 233"" should read --lever 233'--.

UNITED STATES PATENT AND TRADEMARK OFFICE

CERTIFICATE OF CORRECTION

PATENT NO. : 5,437,444

DATED : August 1, 1995

INVENTOR(S) : HIDEAKI KAWAKAMI, ET AL.

It is certified that error appears in the above-identified patent and that said Letters Patent is hereby corrected as shown below:

COLUMN 15

Line 65, "sheers" should read --sheets-- and after "hand" insert a —,—.

COLUMN 18

Line 48, "means," should read --means--.
Line 63, "where in" should read --wherein--.

Signed and Sealed this

Second Day of January, 1996

Bruce Lehman

BRUCE LEHMAN

*Commissioner of Patents and Trademarks*

*Attest:*

*Attesting Officer*